US010800021B2

(12) United States Patent
Tanaka

(10) Patent No.: US 10,800,021 B2
(45) Date of Patent: Oct. 13, 2020

(54) DRIVING TOOL

(71) Applicant: MAX CO., LTD., Chuo-ku, Tokyo (JP)

(72) Inventor: Hiroshi Tanaka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 133 days.

(21) Appl. No.: 16/138,667

(22) Filed: Sep. 21, 2018

(65) Prior Publication Data

US 2019/0099872 A1 Apr. 4, 2019

(30) Foreign Application Priority Data

Sep. 29, 2017 (JP) ..... 2017-191693

(51) Int. Cl.

| | |
|---|---|
| ***B25C 1/08*** | (2006.01) |
| ***B25C 1/04*** | (2006.01) |
| ***B25C 1/00*** | (2006.01) |
| ***B25C 1/18*** | (2006.01) |
| *B25C 5/15* | (2006.01) |
| *B25C 1/06* | (2006.01) |

(52) U.S. Cl.

CPC ..... *B25C 1/043* (2013.01); *B25C 1/008* (2013.01); *B25C 1/042* (2013.01); *B25C 1/046* (2013.01); *B25C 1/047* (2013.01); *B25C 1/184* (2013.01); *B25C 1/06* (2013.01); *B25C 5/15* (2013.01)

(58) Field of Classification Search

CPC ..... B25C 1/042; B25C 1/043; B25C 1/046
See application file for complete search history.

(56) References Cited

U.S. PATENT DOCUMENTS

| | | | | |
|---|---|---|---|---|
| 4,509,668 | A | 4/1985 | Klaus et al. | |
| 6,006,975 | A | 12/1999 | Ishizawa | |
| 2001/0009260 | A1* | 7/2001 | Ishizawa | B25C 1/043 227/8 |

(Continued)

FOREIGN PATENT DOCUMENTS

| | | | |
|---|---|---|---|
| EP | 0 736 360 | A2 | 10/1996 |
| JP | 2008149404 | A * | 7/2008 |

(Continued)

OTHER PUBLICATIONS

European Search Report issued in Application No. 18196165.7, dated Mar. 1, 2019 (9 pages).

*Primary Examiner* — Andrew M Tecco
*Assistant Examiner* — Eyamindae C Jallow
(74) *Attorney, Agent, or Firm* — Rothwell, Figg, Ernst & Manbeck, P.C.

(57) ABSTRACT

A driving tool drives a fastener supplied to a nose using a striking mechanism. The driving tool includes a trigger, a contact arm, a contact lever and a regulator. The trigger receives a manipulation which operates the striking mechanism. The contact arm reciprocates and receives another manipulation which operates the striking mechanism. The contact lever operates according to operations of the trigger and the contact arm and switches operating states of the striking mechanism. The regulator regulates a movement of the contact lever in a range from an operable position where the striking mechanism is operable by the contact lever to an operation standby position where the contact lever is operable by the contact arm, according to a reciprocating movement of the contact arm, and switches operating states of the contact lever according to the contact arm.

11 Claims, 16 Drawing Sheets

(56) References Cited

U.S. PATENT DOCUMENTS

| | | | | |
|---|---|---|---|---|
| 2006/0144379 | A1* | 7/2006 | Wang | B25C 1/043 124/3 |
| 2007/0075113 | A1* | 4/2007 | Tillinghast | B25C 1/008 227/130 |
| 2008/0272169 | A1* | 11/2008 | Liang | B25C 1/043 227/130 |
| 2009/0302087 | A1* | 12/2009 | Liang | B25C 1/008 227/130 |
| 2010/0006619 | A1* | 1/2010 | Liang | B25C 1/18 227/130 |
| 2010/0012698 | A1* | 1/2010 | Liang | B25C 1/043 227/5 |
| 2010/0012699 | A1* | 1/2010 | Liang | B25C 1/043 227/8 |
| 2010/0038398 | A1* | 2/2010 | Liang | B25C 1/042 227/8 |
| 2010/0301091 | A1* | 12/2010 | Liang | B25C 1/008 227/8 |
| 2014/0158740 | A1* | 6/2014 | Akutsu | B25C 1/044 227/130 |
| 2017/0209995 | A1* | 7/2017 | Iijima | B25C 1/008 |
| 2017/0274512 | A1* | 9/2017 | Ishizawa | B25C 1/047 |
| 2018/0117748 | A1 | 5/2018 | Ishikawa et al. | |

FOREIGN PATENT DOCUMENTS

| | | | | |
|---|---|---|---|---|
| JP | 2016-179526 | A | 10/2016 | |
| WO | WO-2016002540 | A1 * | 1/2016 | B25C 7/00 |

* cited by examiner

DRIVING TOOL

CROSS-REFERENCE TO RELATED APPLICATION

This application is based on and claims priority under 35 USC119 from Japanese Patent Application No. P2017-191693 filed on Sep. 29, 2017.

TECHNICAL FIELD

The present invention relates to a driving tool driven by a fluid such as compressed air.

BACKGROUND

A driving tool called as a nailing machine is known, in which the driving tool operates a piston with a striking mechanism using a fluid such as compressed air as a driving power source and drives a driver coupled to the piston, in order to strike a fastener such as a nail coupled to a nose. In such a nailing machine, the striking mechanism is operated by manipulating two members, that is, one manipulation of pulling a trigger provided on a handle and another manipulation of pressing a contact arm that protrudes from a proximal end of the nose so as to reciprocate against a driven member, in order to drive a nail.

In following description, a state in which the trigger is pulled according to one manipulation will be referred to as ON state of the trigger, and a state in which one manipulation is canceled and the trigger is not pulled will be referred to as OFF state of the trigger. In another manipulation, a state in which the contact arm is pressed will be referred to as ON state of the contact arm, and a state in which another manipulation is canceled and the contact arm is not pressed will be referred to as OFF state of the contact arm.

In the nailing machine, for example, after the contact arm is ON, the trigger is ON in a state where the contact arm is ON, and whereby the striking mechanism is operated and a nail driving is performed.

After driving the nail, the trigger and the contact arm are OFF, and then, the trigger and the contact arm are ON again as described above, so that the striking mechanism is operated and a next nail driving is performed. As described above, for every nail driving operation, when the trigger and the contact arm are ON after the trigger and the contact arm are OFF, a next nail driving is performed, and this operation is referred to as a single shot mode.

On the other hand, a technique in which the trigger is maintained to be ON and the contact arm is OFF after driving the nail and then the contact arm is ON again to operate the striking mechanism and perform a next nail driving operation has been suggested. As described above, an operation of continuously performing nail driving operations by repeatedly turning ON/OFF of the contact arm in a state where the ON state of the trigger is maintained is referred to as a continuous strike mode.

In the continuous strike mode, the nail driving may be performed continuously whenever the contact arm is pressed against the driven member in a state where the trigger is pulled after each nail driving operation, and thus, the continuous strike mode is suitable for a fast work. On the other hand, in the single shot mode, since a next nail driving is performed by cancelling manipulations of the trigger and the contact arm after the nail is driven and by pulling the trigger after pressing the contact arm against the driven member, a careless operation may be restricted, but the single shot mode is not suitable for the fast work. Thus, there has been suggested a technique allowing continuous nail driving operations to be performed only with an operation of pressing the contact arm against the driven member without releasing the manipulation of the trigger for a predetermined time period after a first nail driving operation performed by pulling the trigger after pressing the contact arm against the driven member (for example, see JP-A-2016-179526).

SUMMARY

In the configuration in which the continuous strike operation of the nail, etc. may be performed only by pressing the contact arm against the driven member without releasing the manipulation of the trigger, a control allowing the continuous strike operation to be performed for a predetermined time period is made by using an electrical timer, and thus, a time measurement may be stabilized. However, the nailing machine driven by the compressed air does not use a source of electricity. Therefore, in order to use the electrical timer, a power source and a circuit are necessary.

Alternatively, a configuration in which the trigger and a mechanical time measurement mechanism are combined may be suggested. However, the mechanical time measurement mechanism has to be combined with the trigger in a limited space, and it is difficult to stably perform the time measurement. When the time measurement operation may not be performed stably, a time during which the continuous strike operations may be performed is not constant, and manipulation feeling degrades.

The present invention has been made in view of these circumstances, and an object thereof is to provide a driving tool capable of stably performing a switching operation from execution of the continuous strike operations according to the contact arm manipulation to non-execution of the continuous strike operation.

According to one aspect of the disclosure, a driving tool is configured to drive a fastener supplied to a nose by using a striking mechanism. The driving tool includes a trigger, a contact arm, a contact lever and a regulator. The trigger is configured to receive a manipulation which operates the striking mechanism. The contact arm is configured to reciprocate and is configured to receive another manipulation which operates the striking mechanism. The contact lever is configured to operate according to operations of the trigger and the contact arm and is configured to switch operating states of the striking mechanism. The regulator is configured to regulate a movement of the contact lever in a range from an operable position where the striking mechanism is operable by the contact lever to an operation standby position where the contact lever is operable by the contact arm, according to a reciprocating movement of the contact arm, and is configured to switch operating states of the contact lever according to the contact arm.

DETAILED DESCRIPTION

Hereinafter, a nailing machine as an example of a driving tool according to an embodiment of the present invention will be described with reference to accompanying drawings.

An Example of a Nailing Machine According to a First Embodiment

Figure 1:
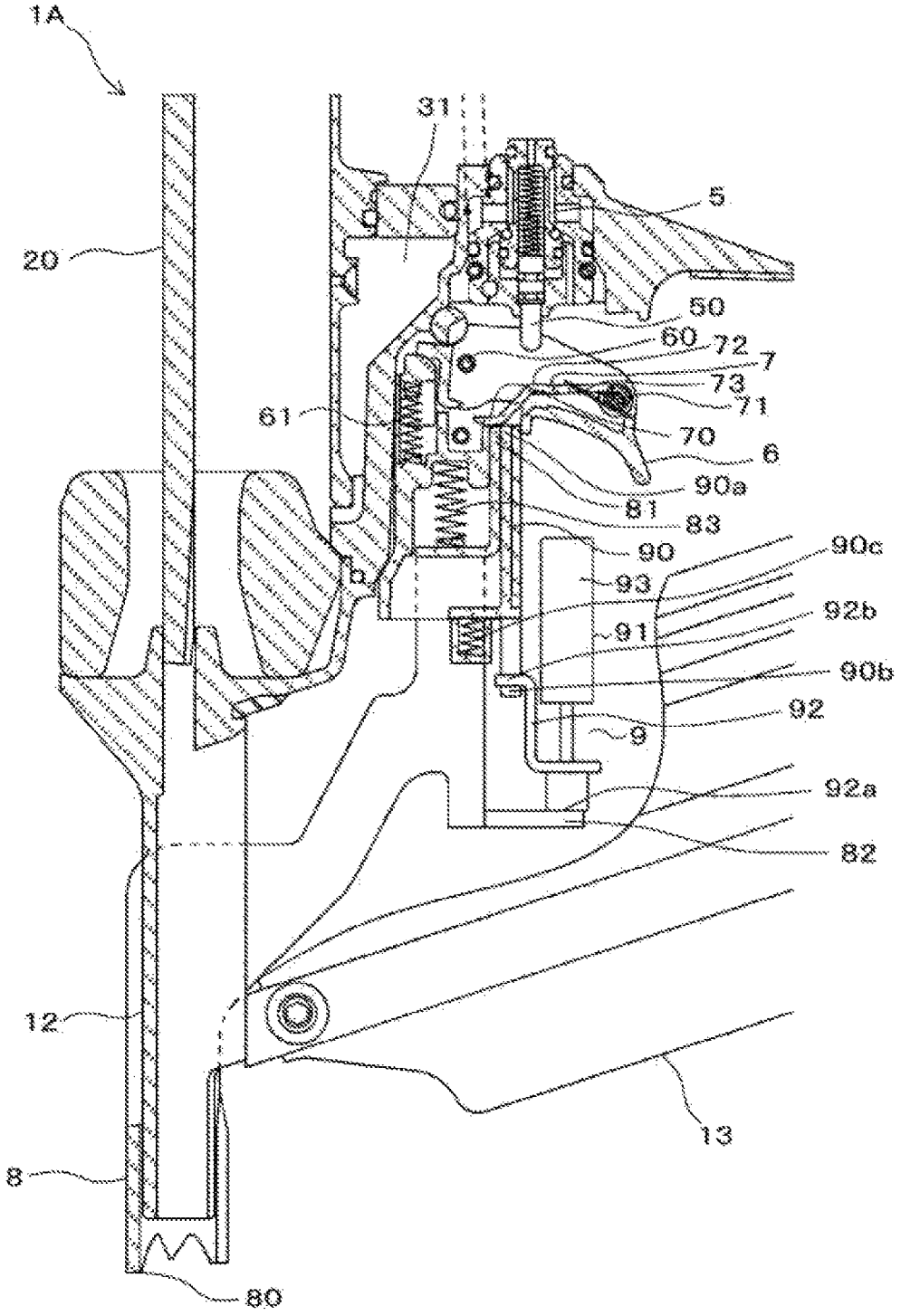
FIG. 1 is a diagram showing a main configuration of a nailing machine according to a first embodiment.
Figure 2:
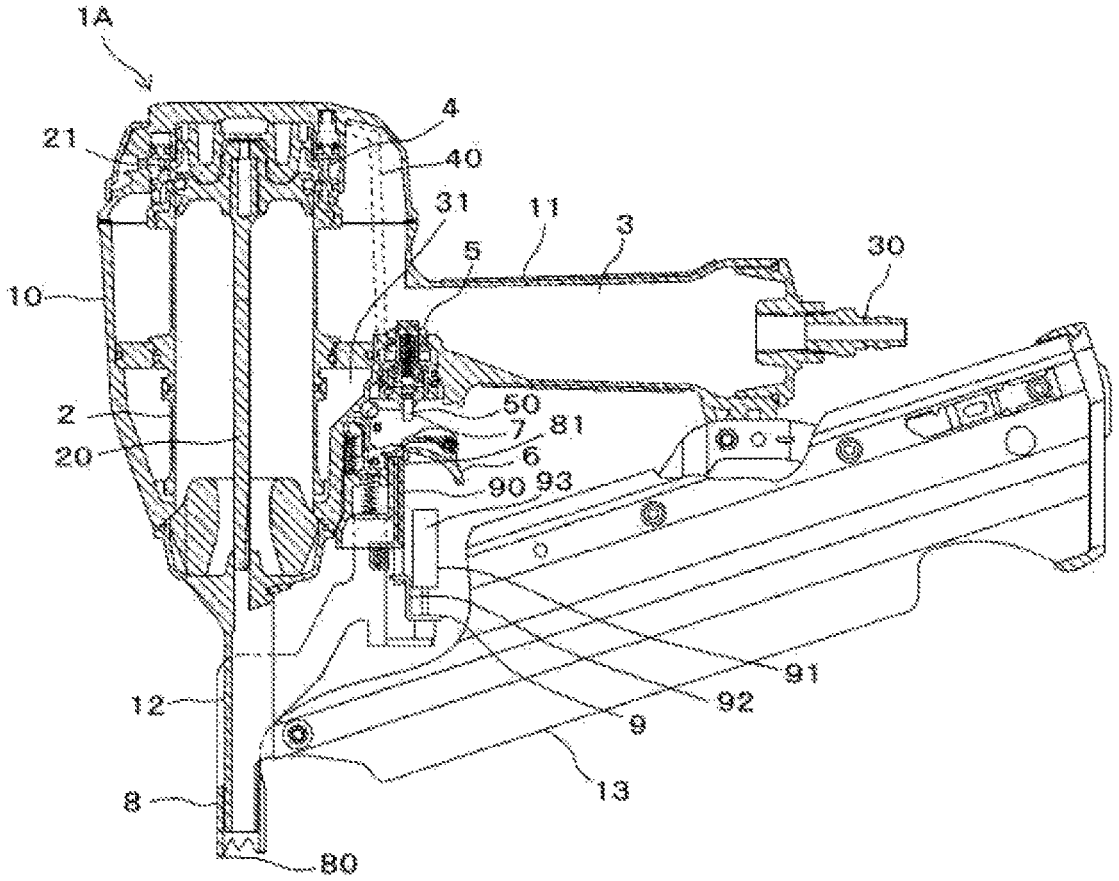
FIG. 2 is a diagram showing whole configuration of a nailing machine according to the first embodiment.

FIG. 1 is a diagram showing a main configuration of a nailing machine according to a first embodiment, and FIG. 2 is a diagram showing whole configuration of the nailing machine according to the first embodiment.

A nailing machine 1A according to the first embodiment includes a striking mechanism 2 including an air cylinder, etc. that operates by using a fluid such as compressed air as a driving source to perform a striking operation, and an air chamber 3 in which the compressed air supplied from an external air compressor (not shown) is stored. In the nailing machine 1A, the striking mechanism 2 is provided in a housing 10 extending in one direction, and the air chamber 3 is provided in a handle 11 extending from the housing 10 in another direction. In the nailing machine 1A, a blowback chamber 31 is provided around a lower portion of the striking mechanism 2 in the housing 10.

The striking mechanism 2 includes a driver 20 that strikes a nail, etc. (not shown), and a piston 21 in which the driver 20 is provided, wherein the piston 21 is provided to slide. In the striking mechanism 2, when the piston 21 is pressed by the compressed air, the piston 21 moves to drive the driver 20.

The compressed air is supplied to the air chamber 3 from a compressed air source, such as an air compressor, via an air plug 30 provided at an end portion of the handle 11. The compressed air for returning the piston 21 after the striking operation to an initial position is supplied to the blowback chamber 31.

The nailing machine 1A includes a nose 12 for accommodating the driver 20 at an end portion of the housing 10, and a magazine 13 for supplying a nail (not shown) to the nose 12. The nose 12 extends along a movement direction of the driver 20. In consideration of an aspect of using the nailing machine 1A, a side including the nose 12 is defined as a downward direction.

The nailing machine 1A includes a main valve 4 that controls inflow/outflow of the compressed air in the air chamber 3 and makes the piston 21 reciprocate, and a starting valve 5 that operates the main valve 4. The main valve 4 reciprocates the piston 21 by switching between inflow of the compressed air into the striking mechanism 2 from the air chamber 3 and discharge of the compressed air from the striking mechanism 2 to the outside. The starting valve 5 includes a valve stem 50 that is provided so as to reciprocate, and the valve stem 50 moves a predetermined distance and opens/closes a flow passage 40 to operate the main valve 4 and reciprocate the piston 21 once.

The nailing machine 1A includes a trigger 6 for receiving a manipulation of operating the starting valve 5, a contact arm 8 that moves by receiving a manipulation of pressing the contact arm 8 against a driven member, in which a nail is driven, and a contact lever 7 that is provided so as to operate according to an operation of the trigger receiving the manipulation and an operation of the contact arm 8 receiving another manipulation and is configured to switch an operating state of the striking mechanism 2 by switching an operating state of the starting valve 5. The nailing machine 1A includes a regulator 9 that regulates a movement, a velocity, or a moving amount of the contact lever 7 according to the reciprocating movement of the contact arm 8 for a predetermined time period, and switches the operating states of the contact arm 8 and the contact lever 7 according to whether the contact lever 7 and the contact arm 8 are locked by each other in the present example.

The trigger 6 is provided on a side of the handle 11, that is, on a side where the nose 12 is provided. An end portion of the trigger 6, that is, a side close to the housing 10, is rotatably supported by an axis 60. A side of the trigger 6, which is opposite to the side supported by the axis 60, that is, another end portion away from the housing 10, is biased by a spring 61 in a direction of moving towards the side on which the nose 12 is provided, by a rotating operation about the axis 60.

A movement range of the trigger 6 according to the rotation about the axis 60 is regulated by a collision of the trigger 6 with an abutting portion provided on the housing 10 and the handle 11. In a state where the manipulation of the trigger 6 is released, the trigger 6 is biased by the spring 61 to move to an initial position by rotating about the axis 60. The trigger 6 is moved from the initial position in the rotation operation about the shaft 60 to an operating position where the contact lever 7 may operate the starting valve 5, according to a pulling manipulation.

The contact lever 7 includes a lock portion 70, by which the contact arm 8 may be locked, at an end portion thereof, and the other end portion of the contact lever 7 is rotatably supported by the trigger 6 due to an axis 71. A pressing portion 72 that is capable of pressing the valve stem 50 of the starting valve 5 is provided between the lock portion 70 and the axis 71. In the contact lever 7, a side opposite to the side supported by the axis 71, that is, an end portion where the lock portion 70 is provided, is biased by a spring 73 such as a twisted coil spring in a direction of moving towards the nose 12 through a rotation about the axis 71.

The contact lever 7 is pressed by the contact arm 8, and is moved through the rotation about the axis 71 from an initial position to a location of operating the striking mechanism 2, that is, a preparation position where the valve stem 50 is pressed to operate the starting valve 5 in the present example, depending on the location of the trigger 6. When the trigger 6 is operated, the contact lever 7 is moved with the trigger 6 when the trigger 6 rotates about the axis 60.

As a result, the initial position and the operable position of the contact lever 7 are relative positions varying depending on a location of the trigger 6, and positions of the lock portion 70 and the pressing portion 72 of the contact lever 7 vary depending on whether the trigger 6 is at the initial position or a manipulation position and whether the contact lever 7 is at the initial position or the operable position.

The contact lever 7 is moved from the initial position to the operable position according to the operation of the contact arm 8, and is moved from the operable position to the initial position according to operations of the contact arm 8 and the regulator 9. The movement of the contact lever 7 between the initial position and the operable position will be described in detail later.

In a state where the trigger 6 and the contact lever 7 are moved to the initial position, the pressing portion 72 of the contact lever 7 is not in contact with the valve stem 50 of the starting valve 5. In a state where the contact lever 7 is moved to the initial position, the pressing portion 72 of the contact lever 7 is not in contact with the valve stem 50 of the starting valve 5 even when the trigger 6 is moved to the operable position. On the other hand, in a state where the contact lever 7 is moved to the operating position, when the trigger 6 is moved to the manipulation position, the pressing portion 72 of the contact lever 7 presses the valve stem 50 of the starting valve 5, and thus, the contact lever 7 may operate the starting valve 5.

The contact arm 8 is provided to be movable along an extending direction of the nose 12, and includes an abutting portion 80 that is brought into contact with a driven member at a proximal end side of the nose 12. The contact arm 8 includes a first pressing portion 81 operating the contact lever 7 and a second pressing portion 82 operating the regulator 9. The contact arm 8 is pressed by a spring 83 in a direction of protruding from the proximal end side of the nose 12.

When the abutting portion 80 is pressed in contact with the driven member, the contact arm 8 is moved from the initial position to the operating position where the first pressing portion 81 operates the contact lever 7 and the second pressing portion 82 operates the regulator 9.

When the first pressing portion 81 is locked by the lock portion 70 of the contact lever 7 by the operation of the contact arm 8 moving from the initial position to the operating position, the contact lever 7 is operated by the operation of the contact arm 8 and the contact lever 7 is moved from the initial position to the operable position. Whether the lock portion 70 of the contact lever 7 and the first pressing portion 81 of the contact arm 8 are locked or unlocked depends upon the position of the trigger 6 and the position of the contact lever 7.

That is, in a state where the trigger 6 is moved to the initial position, when the contact arm 8 is moved to the operating position, the first pressing portion 81 of the contact arm 8 is locked by the lock portion 70 of the contact lever 7 and the contact lever 7 is moved to the operating position. As such, when the trigger 6 is moved to the operating position, the pressing portion 72 of the contact lever 7 presses the valve stem 50 of the starting valve 5 and the contact lever 7 may operate the starting valve 5.

On the contrary, when the trigger 6 is moved to the operating position while the contact arm 8 is moving to the initial position, the first pressing portion 81 is not locked by the lock portion 70 of the contact lever 7 even when the contact arm 8 is moved, and the pressing portion 72 of the contact lever 7 may not press the valve stem 50 of the starting valve 5 even when the trigger 6 is moved to the operating position.

As such, even when the trigger 6 is manipulated first and the contact arm 8 is manipulated, the starting valve 5 may not be operated, and when the contact arm 8 is pressed against the driven member, the continuous strike operation may not be performed. In the present embodiment, by providing the regulator 9, when the contact arm 8 is manipulated first and the trigger 6 is manipulated, the continuous strike operation may be enabled according to whether the contact arm 8 is manipulated or not for a predetermined time period.

The regulator 9 includes a regulation member 90 that regulates the movement, the velocity, or the moving amount of the contact lever 7 and regulates the position of the contact lever 7 to an operation standby position where the contact arm 8 may be operated. The operation standby position is a lockable position where the contact lever 7 may be locked by the contact arm 8. Also, the regulator 9 includes a damper 91 that maintains a state in which the contact lever 7 is located at the lockable position for a predetermined time period by controlling movement of the regulation member 90 that regulates the contact lever 7 at the lockable position. The regulator 9 is partially or entirely provided on an outer portion of the housing 10.

The lockable position of the contact lever 7 is a location or a range in which the contact lever 7 and the contact arm 8 may be locked by each other, and while the contact lever 7 stays at the location or the range, the contact arm 8 may operate the contact lever 7.

Therefore, the regulator 9 regulates the movement, the velocity, or the moving amount of the contact lever 7, the moving amount of the contact lever 7 in the present example, so that the contact lever 7 that has started to move from a preparation position may not pass over the lockable position for a predetermined time period.

The regulation member 90 is provided to be movable along a movement direction of the contact arm 8, and includes a pressing portion 90*a* that presses the contact lever 7 at an end portion thereof along the movement direction. Also, the regulation member 90 includes a locked portion 90*b* that may be locked by the damper 91.

The pressing portion 90*a* of the regulation member 90 is pressed by a spring 90*c* in a direction approaching the contact lever 7. The pressing portion 90*a* of the regulation member 90 presses the lock portion 70 of the contact lever 7, when the pressing portion 90*a* is adjacent to the first pressing portion 81 of the contact arm 8 and the regulation member 90 is pressed to move by the spring 90*c*.

In addition, the regulation member 90 moves from the initial position, at which the pressing portion 90*a* is not in contact with the contact lever 7, to a return regulated position where the pressing portion 90*a* presses the contact lever 7 that is pressed by the contact arm 8 to move to the operable position to regulate the position of the contact lever 7 at the lockable position where the contact lever 7 and the contact arm 8 may be locked by each other.

The damper 91 includes a moving member 92 for moving the regulation member 90, and a controller 93 for controlling a velocity of the moving member 92. The moving member 92 is provided to be movable along a movement direction of the regulation member 90, and includes a pressed portion 92*a* pressed by the second pressing portion 82 of the contact arm 8 and a lock portion 92*b* locked by the locked portion 90*b* of the regulation member 90.

The regulator 9 is provided with the pressed portion 92*a* of the moving member 92 on a movement path of the second pressing portion 82 of the contact arm 8 that moves from the initial position to the operating position. The damper 91 moves from the initial position where the moving member 92 moves the regulation member 90 to the initial position since the pressed portion 92*a* is pressed by the operation of the contact arm 8, to the operable position by being pressed by the contact arm, and after that, moves to the time measurement starting position where a measurement of a time for regulating the moving amount of the contact lever 7 that has moved to the lockable position when the manipulation of the contact arm 8 is released starts.

The locked portion 90*b* of the regulation member 90 is provided on a movement path of the locked portion 90*b* according to the movement of the moving member 92. The damper 91 may release the locked state between the lock portion 92*b* of the moving member 92 and the locked portion 90*b* of the regulation member 90 by the operation of the moving member 92 moving from the initial position to the time measurement starting position. Therefore, the regulation member 90 is pressed by the spring 90*c* to be moved from the initial position to the return regulated position.

When the moving member 92 moves from the time measurement starting position to the initial position, the lock portion 92*b* of the moving member 92 and the locked portion 90*b* of the regulation member 90 are locked by each other. Therefore, the regulation member 90 is moved from the return regulated position to the initial position.

The controller 93, for example, moves the moving member 92 from the time measurement starting position to the initial position by using a spring (not shown), and at the same time, controls a velocity of the moving member 92 by using a sliding load, and a load according to viscosity of a fluid such as gas, liquid, etc.

As such, a time taken for the moving member 92 to move from the time measurement starting position to the initial position may be controlled, and a time for the regulation member 90 to move from the return regulated position to the initial position may be controlled. Therefore, a time taken for the contact lever 7 to return to the initial position is controlled by the operations of the regulation member 90 and the moving member 92, wherein the contact lever 7 is moved to the lockable position by the operation of the contact arm 8 moving to the initial position.

An Example of a Nailing Operation According to the First Embodiment

FIGS. 3 to 8 are diagrams for describing an example of driving a nail according to the first embodiment, and operations of the nailing machine 1A according to the first embodiment will be described below with reference to accompanying drawings.

In an initial state, as shown in FIG. 1, the trigger 6 is at the initial position without being pulled, and the contact arm 8 is also at the initial position without being pushed by the driven member. Therefore, the contact lever 7, the regulation member 90, and the moving member 92 are respectively at the initial positions thereof.

In the initial state in which the trigger 6 is at the initial position and the contact lever 7 is at the initial position, the lock portion 70 of the contact lever 7 is located on the movement path of the first pressing portion 81 of the contact arm 8.

Figure 3:
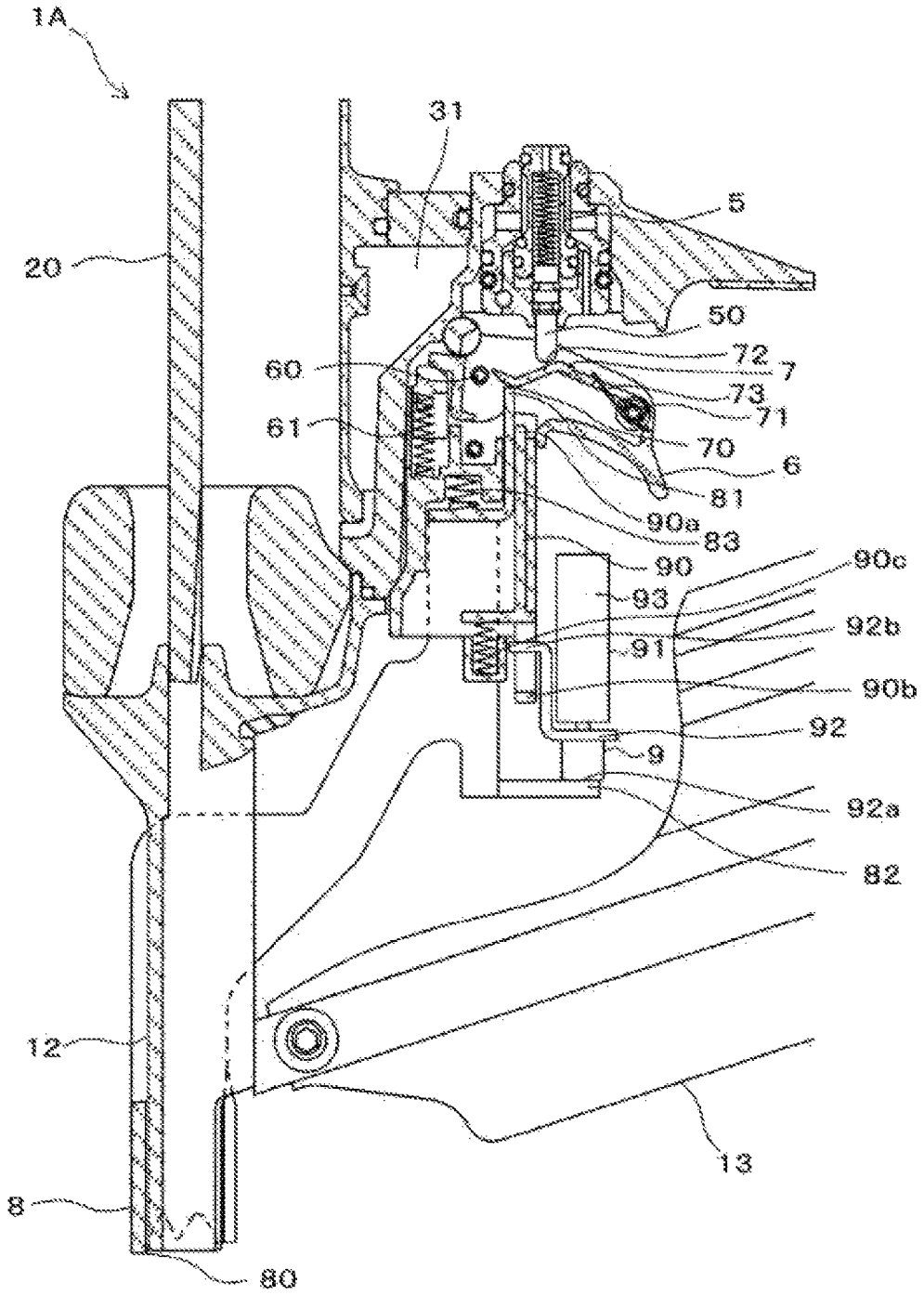
FIG. 3 is a diagram for illustrating an example of a nail driving operation according to the first embodiment.

In the initial state of FIG. 1, when the contact arm 8 is forcedly moved by the driven member from the initial position to the operating position, the first pressing portion 81 of the contact arm 8 presses the lock portion 70 of the contact lever 7 as shown in FIG. 3. Then, the contact lever 7 is moved from the initial position to a preparation position where the valve stem 50 of the starting valve 5 may be pressed to operate the starting valve 5, by rotating about the axis 71. Even when the contact lever 7 moves to the operating position, the valve stem 50 is not pressed by the contact lever 7 unless the trigger 6 is moved to the operating position.

When the contact arm 8 is moved to the operating position, the second pressing portion 82 of the contact arm 8 presses the pressed portion 92*a* of the moving member 92 of the damper 91. Therefore, the moving member 92 of the damper 91 is moved from the initial position to the time measurement starting position.

When the moving member 92 moves to the time measurement starting position, the locked state between the lock portion 92*b* of the moving member 92 and the locked portion 90*b* of the regulation member 90 is released, and the regulation member 90 is pressed by the spring 90*c* to move from the initial position to the return regulated position.

Figure 4:
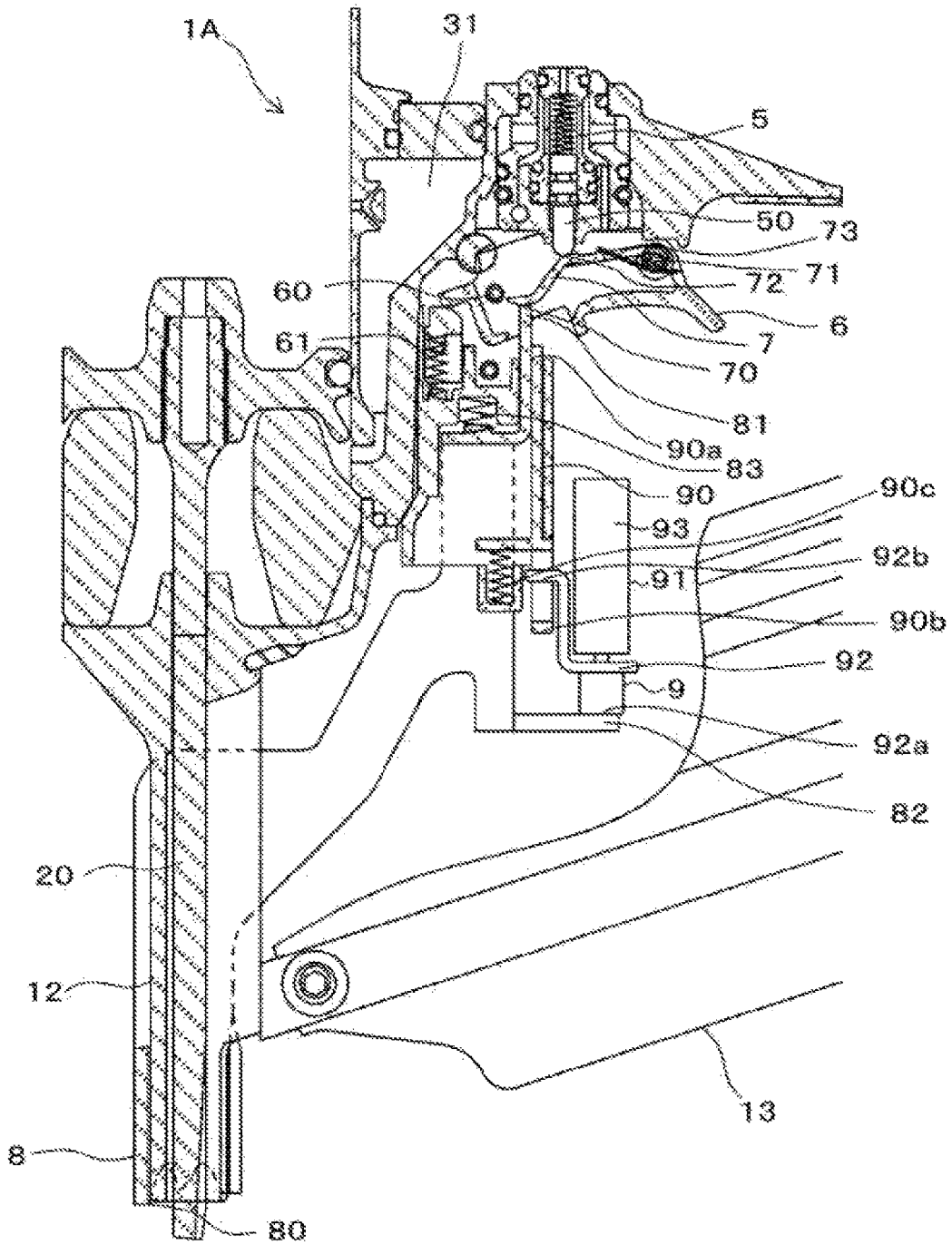
FIG. 4 is a diagram for illustrating an example of a nail driving operation according to the first embodiment.

After the contact arm 8 is moved to the operating position by being forcedly pressed by the driven member in the initial state, when the trigger 6 is pulled to be moved from the initial position to the operating position, the pressing portion 72 of the contact lever 7, which is at the operable position, presses the valve stem 50 of the starting valve 5, as shown in FIG. 4. As a result, the main valve 4 is controlled, the striking mechanism 2 is driven by the compressed air, and the driver 20 is moved in a direction in which a fastener (not shown), that is, a nail in the present example, is driven. Thus, an operation of driving a nail (not shown) may be performed. After the driving operation, the compressed air is supplied from the blowback chamber 31 to the striking mechanism 2, and the driver 20 moves in a returning direction.

Figure 5:
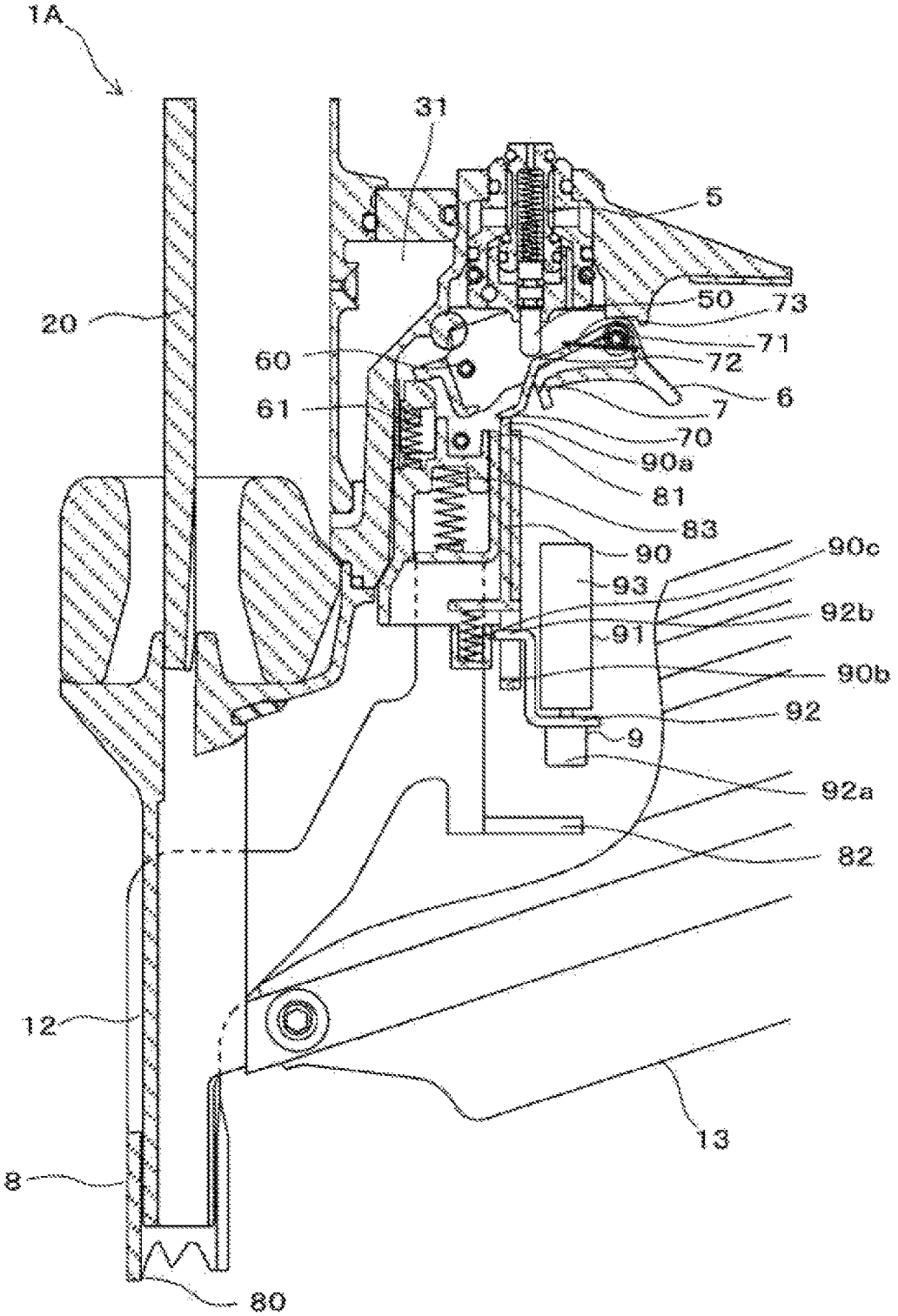
FIG. 5 is a diagram for illustrating an example of a nail driving operation according to the first embodiment.

After the driving operation, while the trigger 6 is maintained at the operating position in a state of being pulled, when the force applied to the contact arm 8 is released, as shown in FIG. 5, the contact arm is moved from the operating position to the initial position by a force of the spring 83.

When the contact arm 8 is moved to the initial position, the pressed state of the contact lever 7 by the first pressing portion 81 is released, and the contact lever 7 starts to move in a direction of returning to the initial position from the operable position by rotating about the axis 71 due to the spring 73.

The pressing portion 90*a* of the regulation member 90 moving to the return regulated position is located on the movement path of the contact lever 7, and regulates the moving amount of the contact lever 7 that moves in a direction of returning from the operable position to the initial position.

As a result, when the contact arm 8 moves to the initial position, the contact lever 7 moves until the contact lever 7 contacts the pressing portion 90*a* of the regulation member 90 and then stops at the lockable position. In addition, the lock portion 70 of the contact lever 7 that moved to the lockable position is located on a movement path of the first pressing portion 81 of the contact arm 8.

When the contact arm 8 moves to the initial position, the pressed state of the moving member 92 of the damper 91 by the second pressing portion 82 of the contact arm 8 is released, and then, the moving member 92 starts to move in a direction of returning from the time measurement starting position to the initial position.

Figure 6:
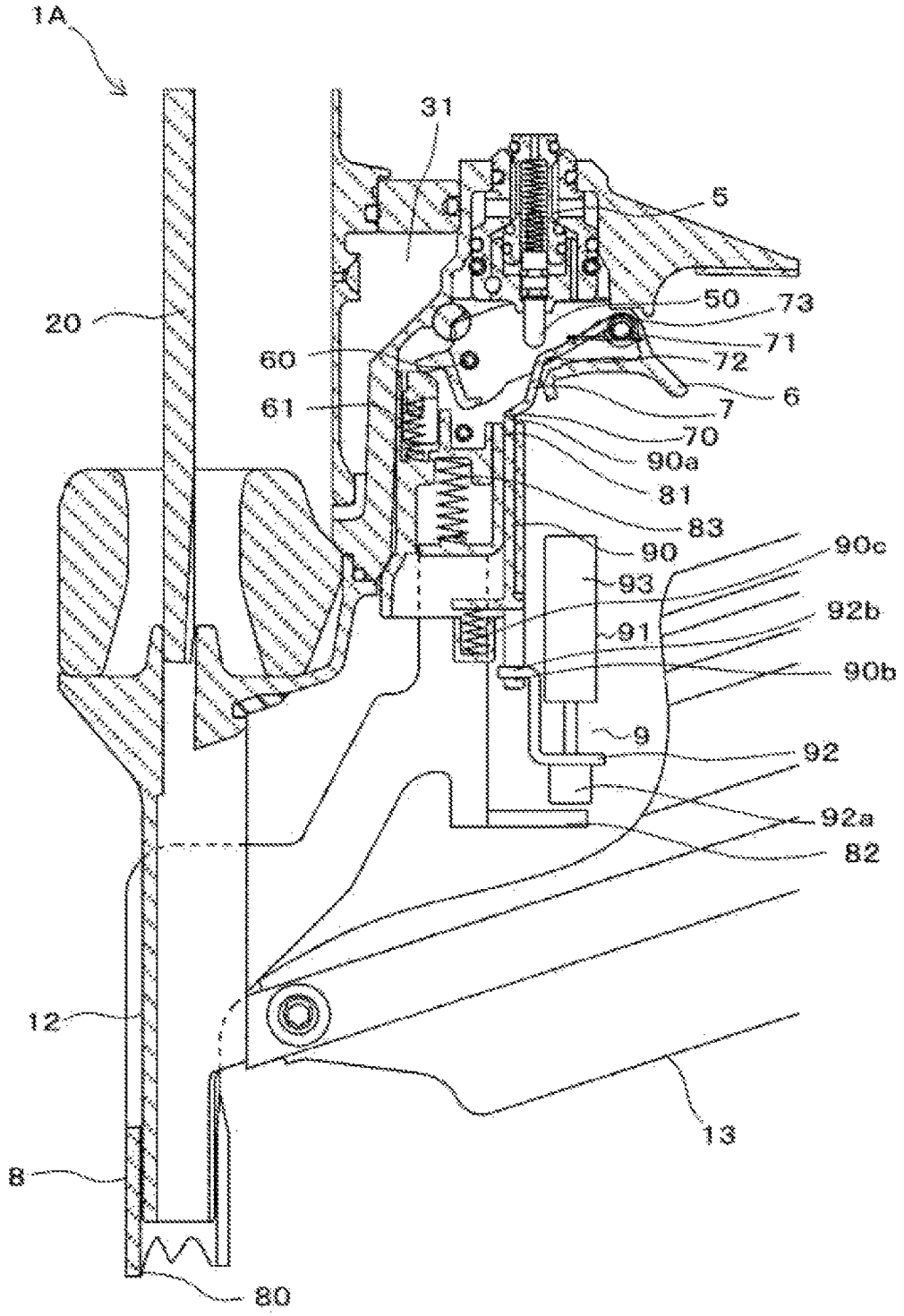
FIG. 6 is a diagram for illustrating an example of a nail driving operation according to the first embodiment.

Although the moving member 92 is moved from the time measurement starting position to the initial position by a spring (not shown), the velocity of the moving member 92 is controlled by the controller 93. As a result, as shown in FIG. 6, the lock portion 92*b* of the moving member 92 and the locked portion 90*b* of the regulation member 90 are not in locked state until the moving member 92 moves to the initial position, and the regulation member 90 stops at the return regulated position.

Therefore, while the moving member 92 moves from the time measurement starting position to the initial position, the contact lever 7 is stopped at the lockable position, and the lock portion 70 is located on the movement path of the first pressing portion 81 of the contact arm 8.

As a result, while the trigger 6 is maintained at the operating position in a state of being pulled, before a predetermined time period passes after the contact arm 8 moves to the initial position and before the moving member 92 moves from the time measurement starting position to the initial position, when the contact arm 8 is moves from the initial position to the operating position by being pressed by the driven member again, the first pressing portion 81 of the contact arm 8 may press the lock portion 70 of the contact lever 7.

Therefore, after the contact arm 8 is moved to the initial position while maintaining the trigger 6 at the operating position in a state of being pulled, when the contact arm 8 is moved again to the operating position, as shown in FIG. 4, the lock portion 70 of the contact lever 7 is pressed by the first pressing portion 81 of the contact arm 8, the contact lever 7 is moved to the operating position, and then, the pressing portion 72 presses the valve stem 50 of the starting valve 5.

Therefore, while the trigger 6 is maintained at the operating position in a state of being pulled, continuous striking operations may be performed for a predetermined time period by pressing the contact arm 8 against the driven member.

On the other hand, while the trigger 6 is at the operating position in a state of being pulled, when a predetermined time passes after the contact arm 8 moves to the initial position, the moving member 92 is moved and reaches to the initial position by the damper 91.

Figure 7:
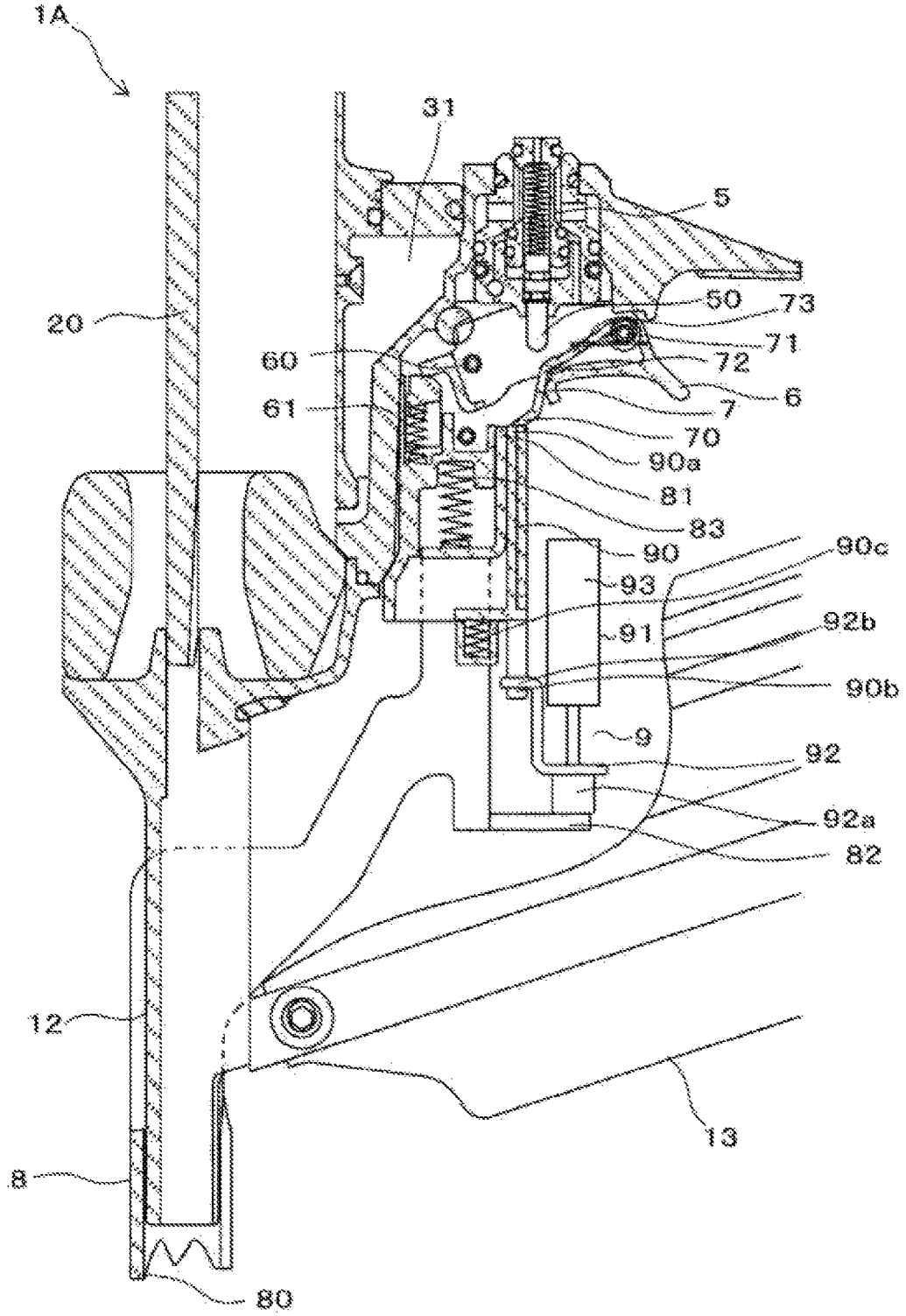
FIG. 7 is a diagram for illustrating an example of a nail driving operation according to the first embodiment.

When the moving member 92 is moved to the initial position, as shown in FIG. 7, the lock portion 92*b* of the moving member 92 and the locked portion 90*b* of the regulation member 90 are locked by each other. Then, the regulation member 90 pressed by the moving member 92 that is moved by the damper 91 is moved from the return regulated position to the initial position.

When the regulation member 90 is moved to the initial position, the contact lever 7 is moved from the lockable position to the initial location by rotating about the axis 71 due to the spring 73, in a case where the trigger 6 is at the operating position. When the contact lever 7 is moved to the initial position in a state where the trigger 6 is maintained at the operating position, the lock portion 70 of the contact lever 7 is evacuated from the movement path of the first pressing portion 81 of the contact arm 8.

Figure 8:
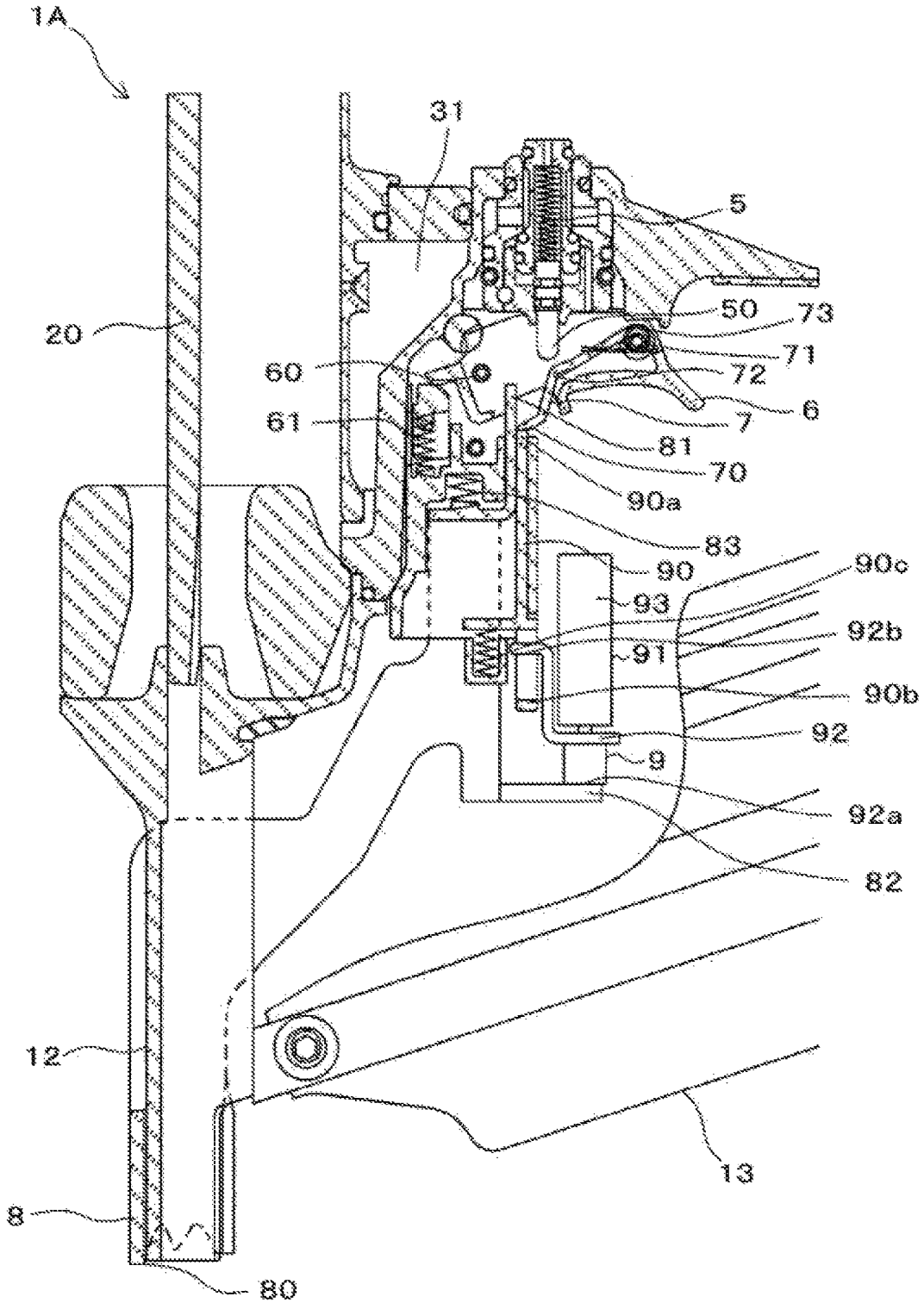
FIG. 8 is a diagram for illustrating an example of a nail driving operation according to the first embodiment.

As a result, after the contact arm 8 is moved to the initial position, when a predetermined time passes while the trigger 6 is maintained at the operating position in a state of being pulled, as shown in FIG. 8, the first pressing portion 81 of the contact arm 8 does not contact the lock portion 70 of the contact lever 7 and the contact lever 7 is not pressed even when the contact arm 8 is moved to the operating position by the operation of pressing the contact arm 8 against the driven member.

Therefore, the starting valve 5 is not pressed by the contact lever 7, and the striking operation is not performed. Therefore, while the trigger 6 is maintained at the operating position in a state of being pulled, the contact arm 8 is pressed against the driven member, and thus, the continuous nailing operations may be controlled according to lapse of time by using a mechanical configuration.

A configuration of maintaining the locked state between the contact lever and the contact arm for a predetermined time period by decreasing the velocity of the contact lever to increase a time taken for the contact lever to move to the initial position may be suggested.

However, it is difficult to stably decrease the velocity of the contact lever, and it is also difficult to stably switch the locked state between the contact lever and the contact arm at a predetermined timing. On the other hand, by providing the regulation member 90 for regulating the moving amount of the contact lever 7 and controlling the movement of the regulation member 90 by using the damper 91, the locked state between the contact lever 7 and the contact arm 8 may be stably switched at a predetermined timing by using a mechanical configuration.

Alternatively, a configuration of combining the damper with the trigger may be suggested in order to decrease the velocity of the contact lever. However, since there is a need to combine the mechanical time measurement mechanism in a restricted area, for example, it is difficult to stably decrease the velocity of the contact lever in order to measure the time. When the time measurement operation may not be performed stably, a time during which the continuous strike operations may be performed is not constant, and manipulation feeling degrades. On the other hand, the regulator 9 is provided on an outer portion of the trigger 6, and thus, a limitation in the space for combining the time measurement mechanism may be eliminated, for example, the regulator 9 may be provided in the housing 10. A configuration for stably performing a measurement operation, for example, increasing of a moving amount of the damper 91 by providing the regulator 9 on an outer portion of the housing 10, may be easily implemented.

When a predetermined time passes after finishing the nailing operation as described above, the contact lever 7 is moved to the initial position. After the contact lever 7 is moved to the initial position, the contact arm 8 is moved to the initial position by releasing the force applied to the contact arm 8. Also, the trigger 6 is moved to the initial position when the force of pulling the trigger 6 is released. As a result, the initial state as shown in FIG. 1 may be obtained. In the initial state, the lock portion 70 of the contact lever 7 is moved to the movement path of the first pressing portion 81 of the contact arm 8.

As shown in FIG. 3, after the contact arm 8 is moved to the operating position by pressing the contact arm 8 against the driven member, as shown in FIG. 4, when the trigger 6 is pulled to move to the manipulation position, the valve stem 50 of the starting valve 5 is pressed by the contact lever 7 moving to the operable position and the nailing operation may be performed.

In the initial state shown in FIG. 1, when the trigger 6 is pulled and moved to the operating position before pressing the contact arm 8 against the driven member, the lock portion 70 of the contact lever 7 is evacuated from the movement path of the first pressing portion 81 of the contact arm 8.

As a result, after setting the trigger 6 at the operating position in a state of pulling the trigger 6, even when the contact arm 8 is moved to the operating position by pressing the contact arm 8 against the driven member, the first pressing portion 81 of the contact arm 8 does not contact the lock portion 70 of the contact lever 7 and thus the contact lever 7 is not pressed.

Therefore, the valve stem 50 of the starting valve 5 is not pressed by the contact lever 7, and the striking operation is not performed. Therefore, before the trigger 6 is pulled, a nailing operation caused by other operations than a regular procedure of pressing the contact arm 8 against the driven member may be restricted.

An Example of a Nailing Machine According to a Second Embodiment

Figure 9:
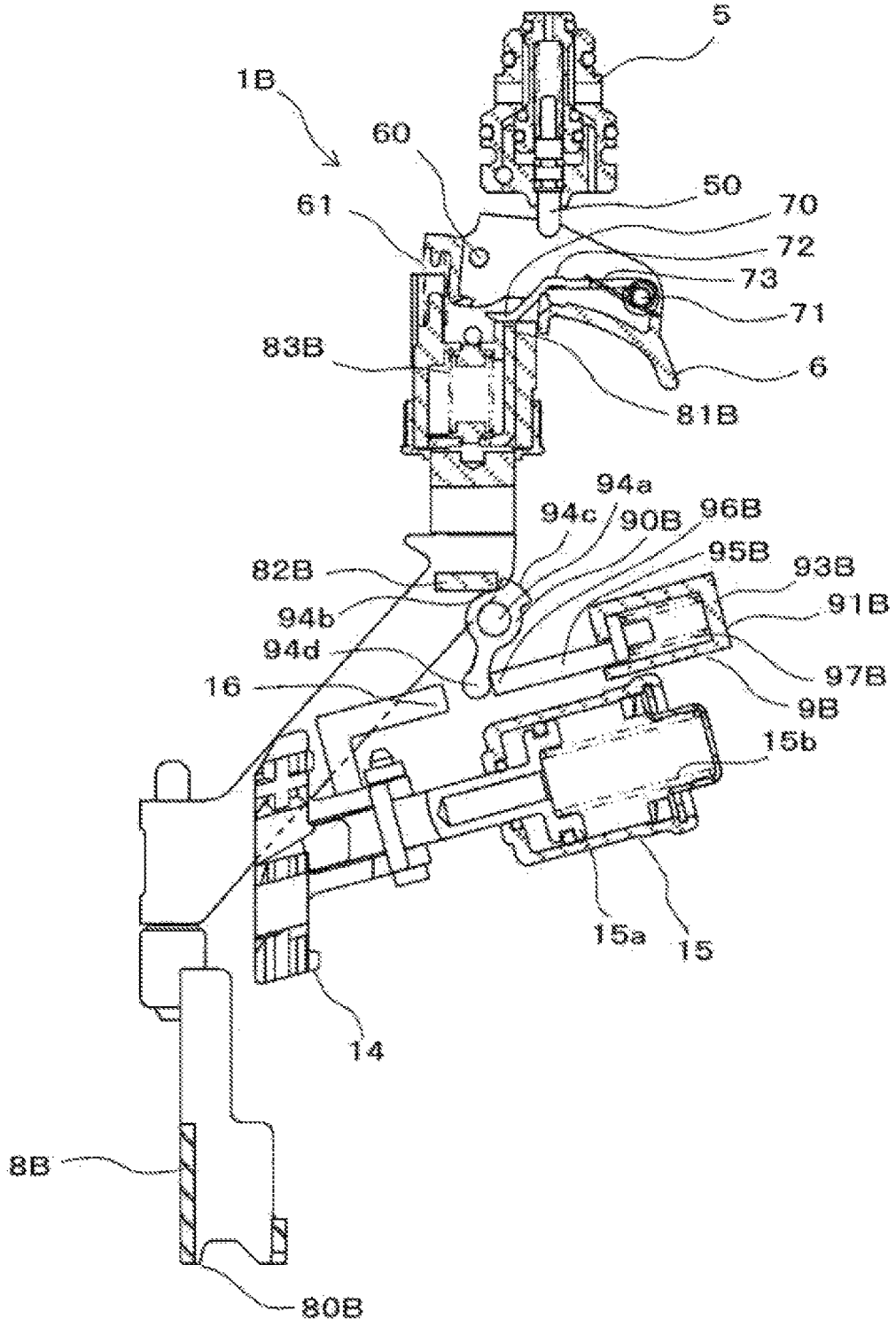
FIG. 9 is a diagram showing a main configuration of a nailing machine according to a second embodiment.
Figure 10:
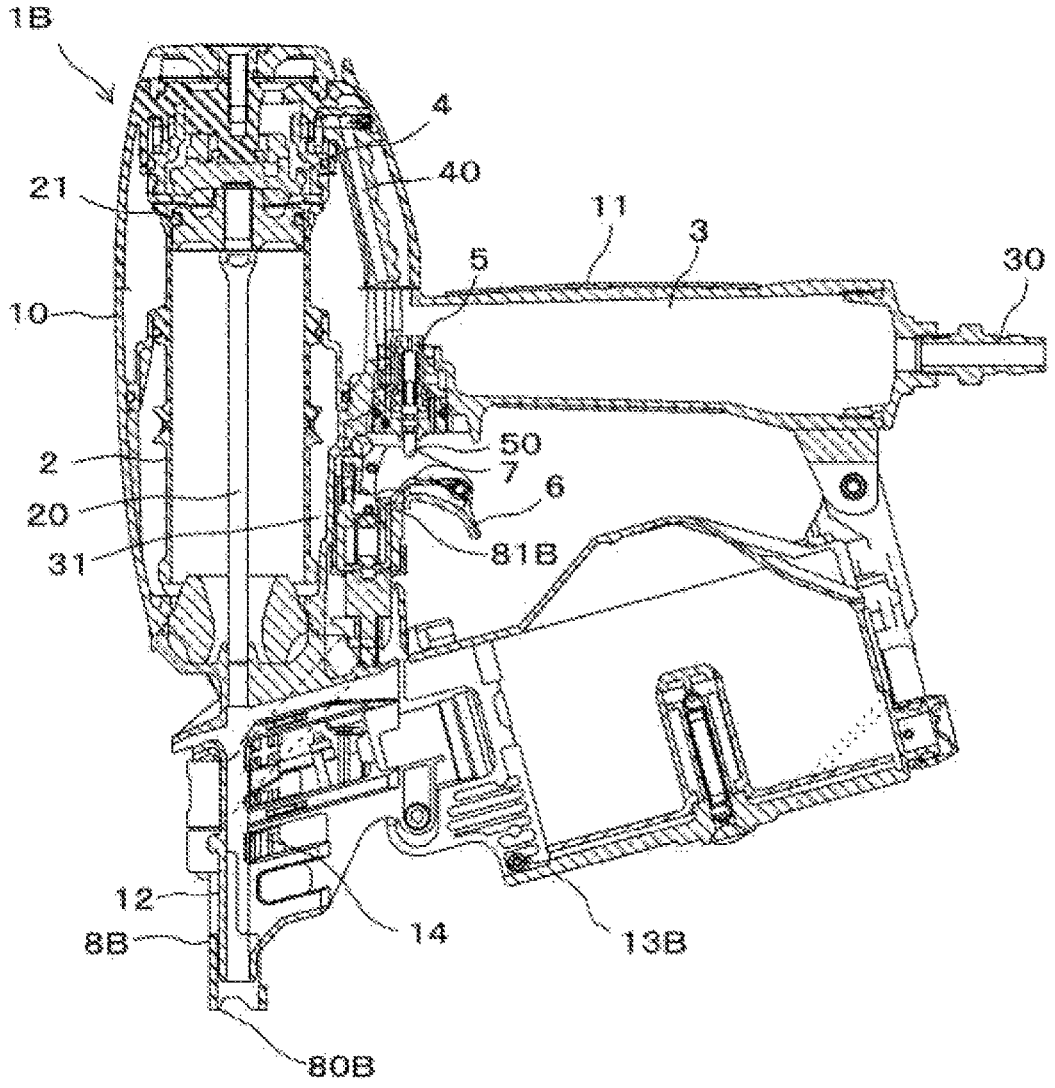
FIG. 10 is a diagram showing whole configuration of a nailing machine according to the second embodiment.

FIG. 9 is a diagram showing a main configuration of a nailing machine according to a second embodiment, and FIG. 10 is a diagram showing whole configuration of the nailing machine according to the second embodiment.

A nailing machine 1B according to the second embodiment includes the striking mechanism 2 including an air cylinder, etc. that operates by using compressed air to perform a striking operation, and the air chamber 3 in which the compressed air supplied from an external air compressor (not shown) is stored. In the nailing machine 1B, the striking mechanism 2 is provided in the housing 10 extending in one direction, and the air chamber 3 is provided in the handle 11 extending from the housing 10 in another direction. In the nailing machine 1B, the blowback chamber 31 is provided around a lower portion of the striking mechanism 2 in the housing 10.

The striking mechanism 2 includes the driver 20 that strikes a nail, etc. (not shown), and the piston 21 in which the driver 20 is provided, wherein the piston 21 is provided so as to slide. In the striking mechanism 2, when the piston 21 is pressed by the compressed air, the piston 21 moves to drive the driver 20.

The compressed air is supplied to the air chamber 3 from a compressed air source such as an air compressor, via the air plug 30 provided at an end portion of the handle 11. The compressed air for returning the piston 21 after the striking operation to an initial position is supplied to the blowback chamber 31.

The nailing machine 1B includes the nose 12 for accommodating the driver 20 at an end portion of the housing 10, and a magazine 13B for supplying a nail (not shown) to the nose 12. The nose 12 extends along a moving direction of the driver 20. In consideration of an aspect of using the nailing machine 1B, a side including the nose 12 is defined as a downward direction.

The nailing machine 1B includes a feed member 14 supplying a nail (not shown) to the nose 12, and a drive mechanism 15 moving the feed member 14 in a direction of contacting or separating from the nose 12.

The drive mechanism 15 includes a piston 15*a* pressed by compressed air, and a spring 15*b* for pressing the piston 15*a* in a direction opposite to the pressing direction by the compressed air. The drive mechanism 15 operates with the compressed air supplied from the blowback chamber 31 at a timing of returning the driver 20, wherein the blowback chamber 31 stores the air for returning the driver 20 after the nailing operation, and according to a reciprocating movement of the feed member 14 that is moved in a direction approaching the nose 12 by the spring 15*b* after being moved in a direction away from the nose 12 by the compressed air in linkage with the operation of hitting the nail, the nail accommodated in the magazine 13B is supplied to the nose 12.

The nailing machine 1B includes a pressing portion 16 operating a regulator 9B that will be described later. The pressing portion 16 is provided on the feed member 14, and is moved with movement of the feed member 14 by the drive mechanism 15.

The nailing machine 1B includes the main valve 4 that controls inflow/outflow of the compressed air in the air chamber 3 and makes the piston 21 reciprocate, and the starting valve 5 that operates the main valve 4. The main valve 4 makes the piston reciprocate 21 by switching between inflow of the compressed air into the striking mechanism 2 from the air chamber 3 and discharge of the compressed air from the striking mechanism 2 to the outside. The starting valve 5 includes the valve stem 50 that is provided so as to reciprocate, and the valve stem 50 moves a predetermined distance and opens/closes a flow passage 40 to operate the main valve 4 and reciprocate the piston 21 once.

The nailing machine 1B includes the trigger 6 receiving a manipulation for operating the starting valve 5, a contact arm 8B that moves by receiving another manipulation for pressing the contact arm 8B against a driven member, in which a nail is driven, and the contact lever 7 that is provided to operate according to an operation of the trigger receiving one manipulation and an operation of the contact arm 8B receiving another manipulation and is configured to switch an operating state of the striking mechanism 2 by switching an operating state of the starting valve 5. Also, the nailing machine 1B includes a regulator 9B that regulates a movement, a velocity, or a moving amount of the contact lever 7 according to the reciprocating movement of the contact arm 8B for a predetermined time period, and switches the operating states of the contact arm 8B and the contact lever 7 according to whether the contact lever 7 and the contact arm 8B are locked with each other in the present example.

The trigger 6 is provided on a side of the handle 11, that is, on a side where the nose 12 is provided. An end portion of the trigger 6, that is, a side close to the housing 10, is rotatably supported by the axis 60. A side of the trigger 6, which is opposite to the side supported by the axis 60, that is, another end portion away from the housing 10, is biased by the spring 61 in a direction of moving towards the side on which the nose 12 is provided, through a rotating operation about the axis 60.

A movement range of the trigger 6 according to the rotation about the axis 60 is regulated by a collision of the trigger 6 with an abutting portion provided on the housing 10 and the handle 11. In a state where the manipulation of the trigger 6 is released, the trigger 6 is biased by the spring 61 to move to an initial position through the rotation operation about the axis 60. The trigger 6 is moved from the initial position in the rotation operation about the shaft 60 to an operating position where the contact lever 7 may operate the starting valve 5, according to a pulling manipulation.

The contact lever 7 includes the lock portion 70, by which the contact arm 8B may be locked, at an end portion thereof, and the other end portion of the contact lever 7 is rotatably supported by the trigger 6 due to an axis 71. Also, a pressing portion 72 that is capable of pressing the valve stem 50 of the starting valve 5 is provided between the lock portion 70 and the axis 71. In the contact lever 7, a side opposite to the side supported by the axis 71, that is, an end portion where the lock portion 70 is provided, is biased by a spring 73 such as a twisted coil spring in a direction of moving towards the nose 12 through a rotation about the axis 71.

The contact lever 7 is pressed by the contact arm 8B, and is moved, through the rotation about the axis 71, from an initial position to a location of operating the striking mechanism 2, that is, a preparation position where the valve stem 50 is pressed to operate the starting valve 5 in the present example, depending on the location of the trigger 6. When the trigger 6 is operated, the contact lever 7 is moved with the trigger 6 by the rotation of the trigger 6 about the axis 60.

As a result, the initial position and the operable position of the contact lever 7 are relative positions varying depending on a location of the trigger 6, and positions of the lock portion 70 and the pressing portion 72 of the contact lever 7 vary depending on whether the trigger 6 is at the initial position or a manipulation position and whether the contact lever 7 is at the initial position or the operable position.

The contact lever 7 is moved from the initial position to the operable position according to the operation of the contact arm 8B, and is moved from the operable position to the initial position according to operations of the contact arm 8B and the regulator 9. The movement of the contact lever 7 between the initial position and the operable position will be described in detail later.

In a state where the trigger 6 and the contact lever 7 are moved to the initial positions, the pressing portion 72 of the contact lever 7 is not in contact with the valve stem 50 of the starting valve 5. In a state where the contact lever 7 is moved to the initial position, the pressing portion 72 of the contact lever 7 is not in contact with the valve stem 50 of the starting valve 5 even when the trigger 6 is moved to the operating position. On the other hand, in a state where the contact lever 7 is moved to the operating position, when the trigger 6 is moved to the operating position, the pressing portion 72 of the contact lever 7 presses the valve stem 50 of the starting valve 5, and thus, the contact lever 7 may operate the starting valve 5.

The contact arm 8B is provided to be movable along an extending direction of the nose 12, and includes an abutting portion 80B that is brought into contact with a driven member at a proximal end side of the nose 12. In addition, the contact arm 8B includes a pressing portion 81B operating the contact lever 7, and a position regulator 82B, by which the regulator 9B is locked. The contact arm 8B is pressed by a spring 83B in a direction of protruding from the proximal end side of the nose 12.

When the abutting portion 80B is pressed by abutting on the driven member, the contact arm 8B is moved from the initial position to the operating position where the pressing portion 81B operates the contact lever 7.

When the pressing portion 81B is locked by the lock portion 70 of the contact lever 7 according to the operation of the contact arm 8B moving from the initial position to the operating position, the contact lever 7 is operated by the operation of the contact arm 8B and the contact lever 7 is moved from the initial position to the operable position. Whether the lock portion 70 of the contact lever 7 and the pressing portion 81B of the contact arm 8B are locked or unlocked depends upon the position of the trigger 6 and the position of the contact lever 7.

The regulator 9B regulates a movement, a velocity, or a moving amount of the contact arm 8B, and includes a regulation member 90B that regulates a movement, a velocity, or a moving amount of the contact lever 7 and regulates the contact lever 7 and the contact arm 8B to an operation standby position where the contact lever 7 may be operated by the contact arm 8B. The operation standby position is a lockable position where the contact lever 7 may be locked by the contact arm 8B. In addition, the regulator 9B includes a damper 91B that maintains a state in which the contact lever 7 and the contact arm 8B are at the lockable position for a predetermined time period by controlling the movement of the regulation member 90B that regulates the contact lever 7 and the contact arm 8B at the lockable position. The regulator 9B is partially or entirely provided on an outer portion of the housing 10.

The lockable position of the contact lever 7 and the contact arm 8B is a location or a range where the contact lever 7 may be locked by the contact arm 8B, and while the contact lever 7 and the contact arm 8B stay at the location or the range, the contact arm 8B may operate the contact lever 7.

Therefore, the regulator 9B regulates the movement, the velocity, or the moving amount of the contact lever 7 and the contact arm 8B, so that the contact lever 7 that has started to move from the operable position does not pass over the lockable position for a predetermined time period. In the present example, moving amounts of the contact lever 7 and the contact arm 8B are regulated.

The regulation member 90B is provided to be rotatable about an axis 94*a*, and includes a first abutted portion 94*b* that regulates the contact lever 7 and the contact arm 8B to the initial position, and a second abutted portion 94*c* that protrudes from the first abutted portion 94*b* to regulate the contact lever 7 and the contact arm 8B to the lockable position. Also, the regulation member 90B includes a pressing portion 94*d* that is pressed by the pressing portion 16 of the feed member 14, and at the same time, presses the damper 91B.

The regulation member 90B rotates about the axis 94*a* to rotate from an initial position where the first abutted portion 94*b* is located on a movement path of the position regulator 82B of the contact arm 8B with the rotation operation and to move to a return regulated position where the second abutted portion 94*c* is located on the movement path of the position regulator 82B of the contact arm 8B to regulate the locations of the contact lever 7 and the contact arm 8B at the lockable position on which the contact lever 7 and the contact arm 8B may be locked by each other.

The damper 91B includes a moving member 95B for moving the regulation member 90B, and a controller 93B for controlling a velocity of the moving member 95B. The moving member 95B is provided to be movable along a moving direction of the feed member 14, and includes a pressed portion 96B that is pressed by the pressing portion 94*d* of the regulation member 90B.

The damper 91B moves from an initial position where the pressed portion 96B is pressed via the regulation member 90B due to the operation of the feed member and the moving member 95B moves the regulation member 90B to the initial position, to a time measurement starting position where measurement of a time of regulating the moving amounts of the contact lever 7 and the contact arm 8B that have moved to the lockable position because the manipulation of the contact arm 8B is canceled is started.

The controller 93B, for example, moves the moving member 95B from the time measurement starting position to the initial position by using a spring 97B, and at the same time, controls a velocity of the moving member 95B by using a sliding load, and a load according to viscosity of a fluid such as gas, liquid, etc.

As such, a time taken for the moving member 95B to move from the time measurement starting position to the initial position may be controlled, and a time for the regulation member 90B to move from the return regulated position to the initial position may be controlled. Therefore, a time taken for the contact lever 7 and the contact arm 8B that have moved to the lockable position to return to the initial position may be controlled.

An Example of a Nailing Operation According to the Second Embodiment

FIGS. 11 to 16 are diagrams for describing an example of driving a nail according to the second embodiment, and operations of the nailing machine 1B according to the second embodiment will be described below with reference to accompanying drawings.

In an initial state, as shown in FIG. 9, the trigger 6 is at the initial position without being pulled, and the contact arm 8B is also at the initial position without being pushed by the driven member. Therefore, the contact lever 7, the regulation member 90B, and the moving member 95B are respectively at the initial positions thereof.

In the initial state in which the trigger 6 is at the initial position and the contact lever 7 is at the initial position, the lock portion 70 of the contact lever 7 is located on the movement path of the pressing portion 81B of the contact arm 8B.

Figure 11:
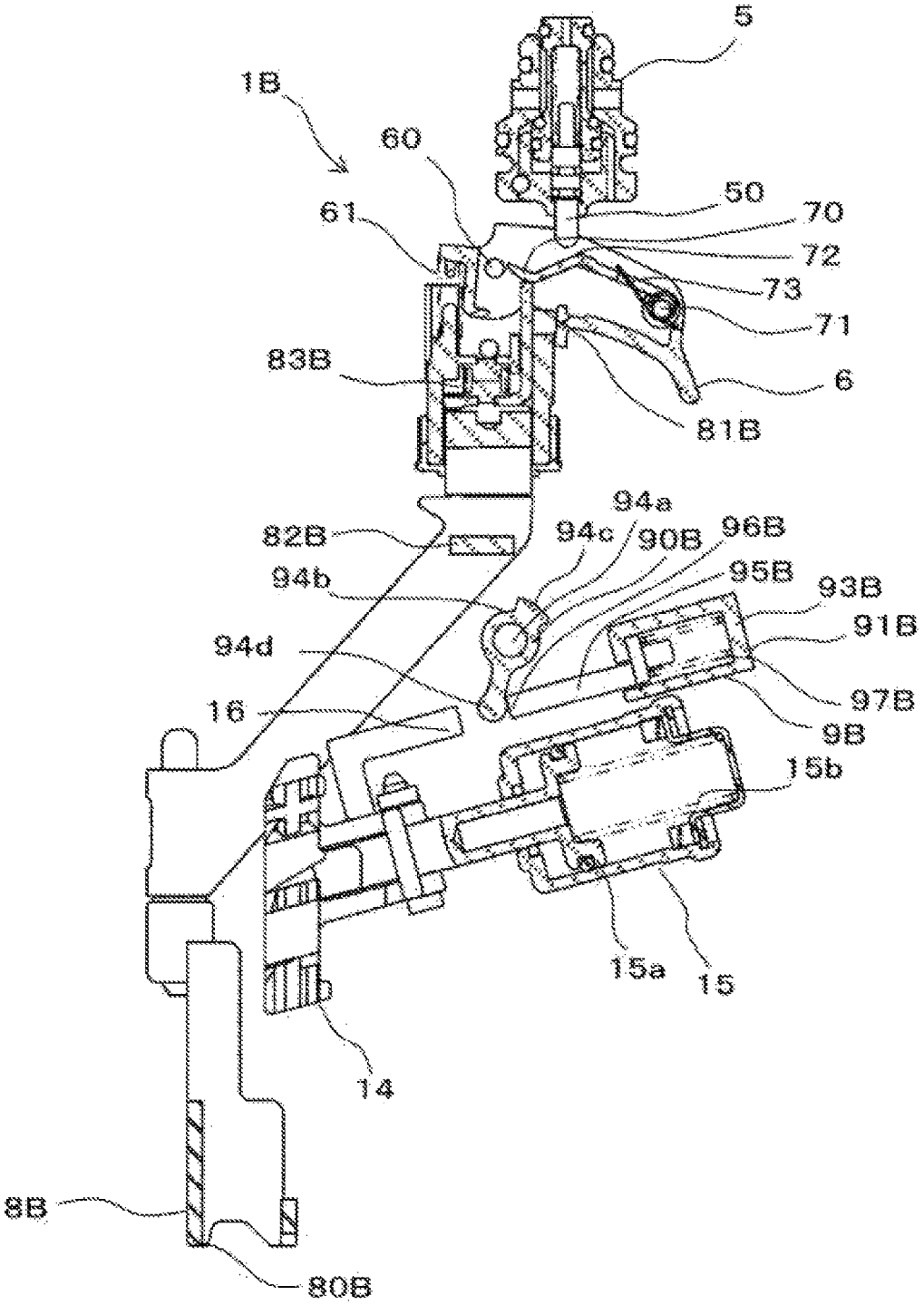
FIG. 11 is a diagram for describing an example of a nail driving operation according to the second embodiment.

In the initial state of FIG. 9, when the contact arm 8B is forcedly moved by the driven member from the initial position to the operating position, the pressing portion 81B of the contact arm 8B presses the lock portion 70 of the contact lever 7 as shown in FIG. 11. Then, the contact lever 71 is moved from the initial position to a preparation position where the valve stem 50 of the starting valve 5 may be pressed to operate the starting valve 5, by rotating about the axis 71. Even when the contact lever 7 moves to the operable position, the valve stem 50 is not pressed by the contact lever 7 unless the trigger 6 is moved to the operable position.

Figure 12:
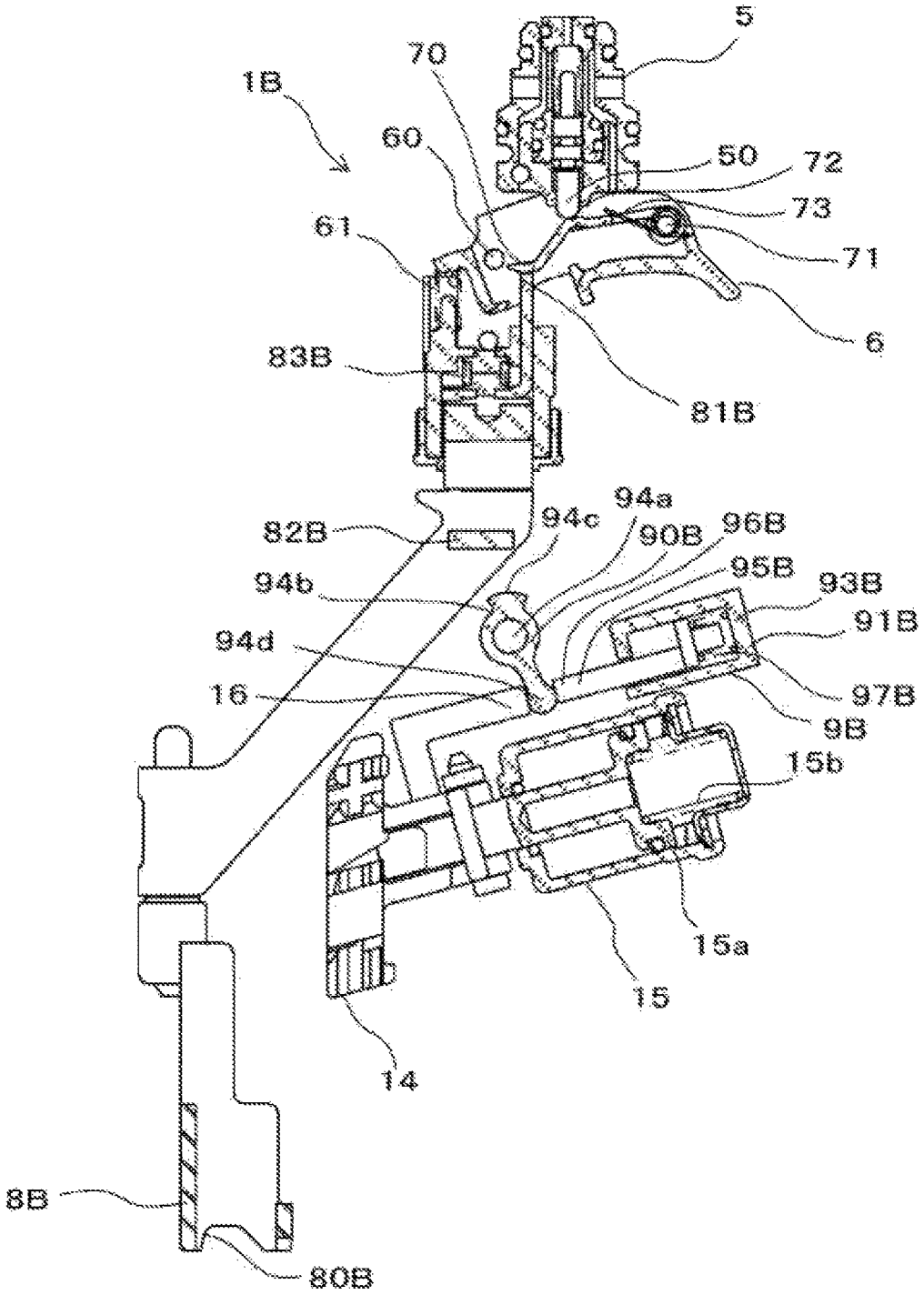
FIG. 12 is a diagram for illustrating an example of a nail driving operation according to the second embodiment.

After the contact arm 8B is moved to the operating position by being forcedly pressed by the driven member in the initial state, when the trigger 6 is pulled to be moved from the initial position to the operable position, the pressing portion 72 of the contact lever 7, which is at the operable position, presses the valve stem 50 of the starting valve 5, as shown in FIG. 12. As a result, the main valve 4 is controlled, the striking mechanism 2 is driven by the compressed air, and the driver 20 is moved in a direction in which a fastener (not shown), that is, a nail in the present example, is driven. Thus, an operation of driving a nail (not shown) may be performed. After the nailing operation, the compressed air is supplied from the blowback chamber 31 to the striking mechanism 2, and the driver 20 moves in a returning direction.

In linkage with the nailing operation, the compressed air is supplied from the blowback chamber 31, and the drive mechanism 15 reciprocates the feed member 14 to supply the nail accommodated in the magazine 13B to the nose 12.

When the feed member 14 moves in a direction away from the nose 12, the pressing portion 16 presses the pressing portion 94*d* of the regulation member 90B. Therefore, the regulation member 90B moves from the initial position to the return regulated position by rotating about the axis 94*a*. When the regulation member 90B moves to the return regulated position, the pressing portion 94*d* of the regulation member 90B presses the pressed portion 96B of the moving member 95B of the damper 91B. Then, the moving member 95B of the damper 91B moves from the initial position to the time measurement starting position.

Figure 13:
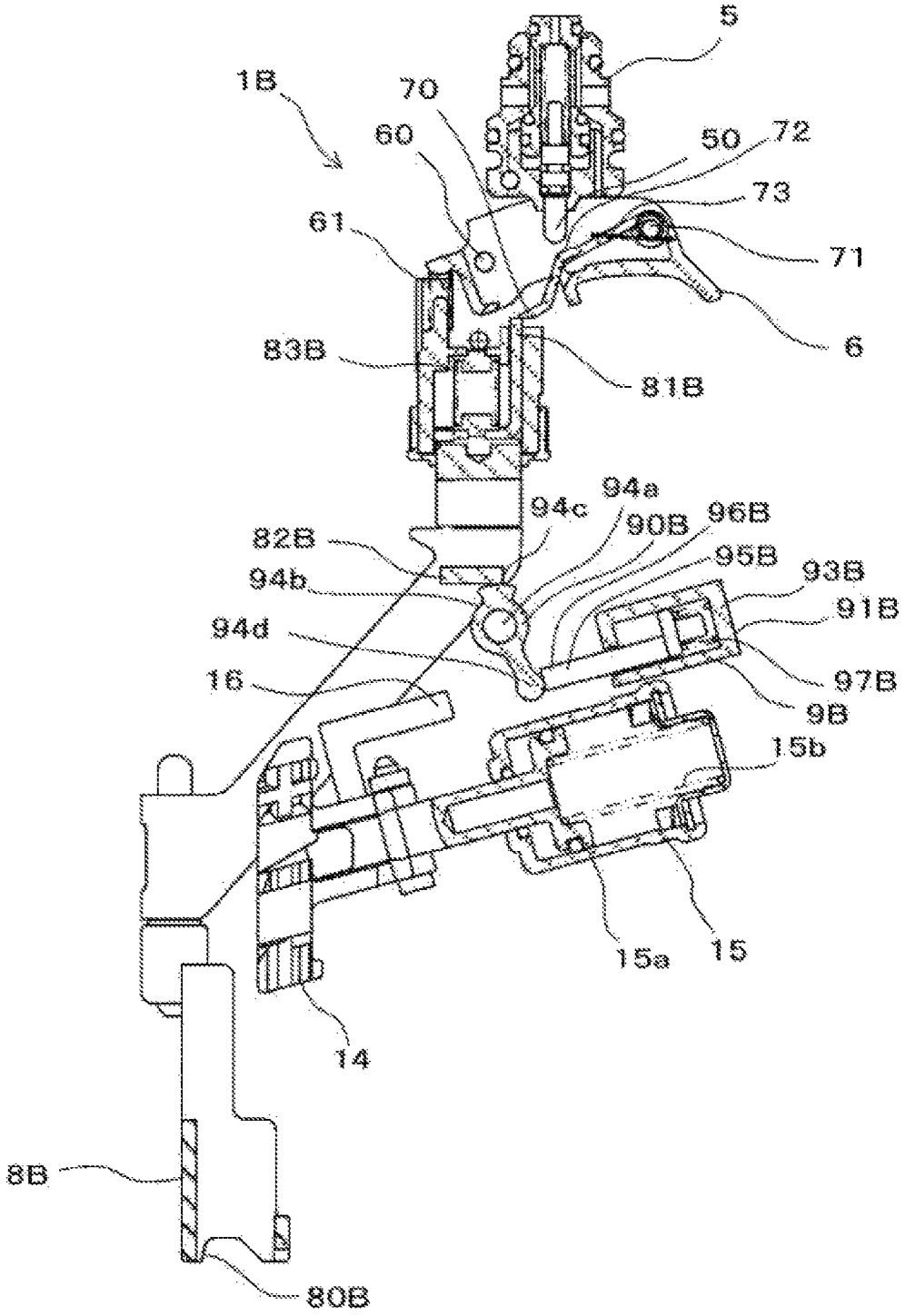
FIG. 13 is a diagram for illustrating an example of a nail driving operation according to the second embodiment.

After the nailing operation, when the force applied to the contact arm 8B is released in a state where the trigger 6 is maintained at the operating position while being pulled, as shown in FIG. 13, the contact arm 8B is moved from the operating position to the initial position by a force of the spring 83B.

As described above, due to the operation of the feed member 14, the regulation member 90B is moved to the return regulated position at which the second abutted portion 94*c* is located on the movement path of the position regulator 82B of the contact arm 8B. Then, the moving amount of the contact arm 8B is restricted when the position regulator 82B abuts on the second abutted portion 94*c* of the regulation member 90B, and the contact arm 8B is moved to the lockable position.

Since the contact lever 7 is biased by the spring 73 in a direction of being pressed by the pressing portion 81B of the contact arm 8B, the contact lever 7 is moved from the operable position to the lockable position by rotating about the axis 71 due to the force of the spring 73 in linkage with the operation of the contact arm 8B moving to the lockable position. In addition, the contact lever 7 and the contact arm 8B moved to the lockable position may maintain a state in which the lock portion 70 of the contact lever 7 is locked by the pressing portion 81B of the contact arm 8B.

When the feed member 14 moves to the initial position through the reciprocating movement, the pressed state of the pressing portion 94*d* of the regulation member 90B by the pressing portion 16 of the feed member 14 is released, and then, the moving member 95B starts to move in a direction of returning to the initial position from the time measurement starting position.

When the moving member 95B is moved from the time measurement starting position to the initial position by the force of the spring 97B, the pressed portion 96B of the moving member 95B presses the pressing portion 94*d* of the regulation member 90B. Therefore, the regulation member 90B rotates about the axis 94*a*.

However, until the moving member 95B is moved to the initial position, the second abutted portion 94*c* of the regulation member 90B is located on the movement path of the position regulator 82B of the contact arm 8B. Also, although the moving member 95B is moved from the time measurement starting position to the initial position by the force of the spring 97B, the velocity of the moving member 95B is controlled by the controller 93B. As such, a time period during which the second abutted portion 94*c* stays on the movement path of the position regulator 82B of the contact arm 8B is adjusted.

Figure 14:
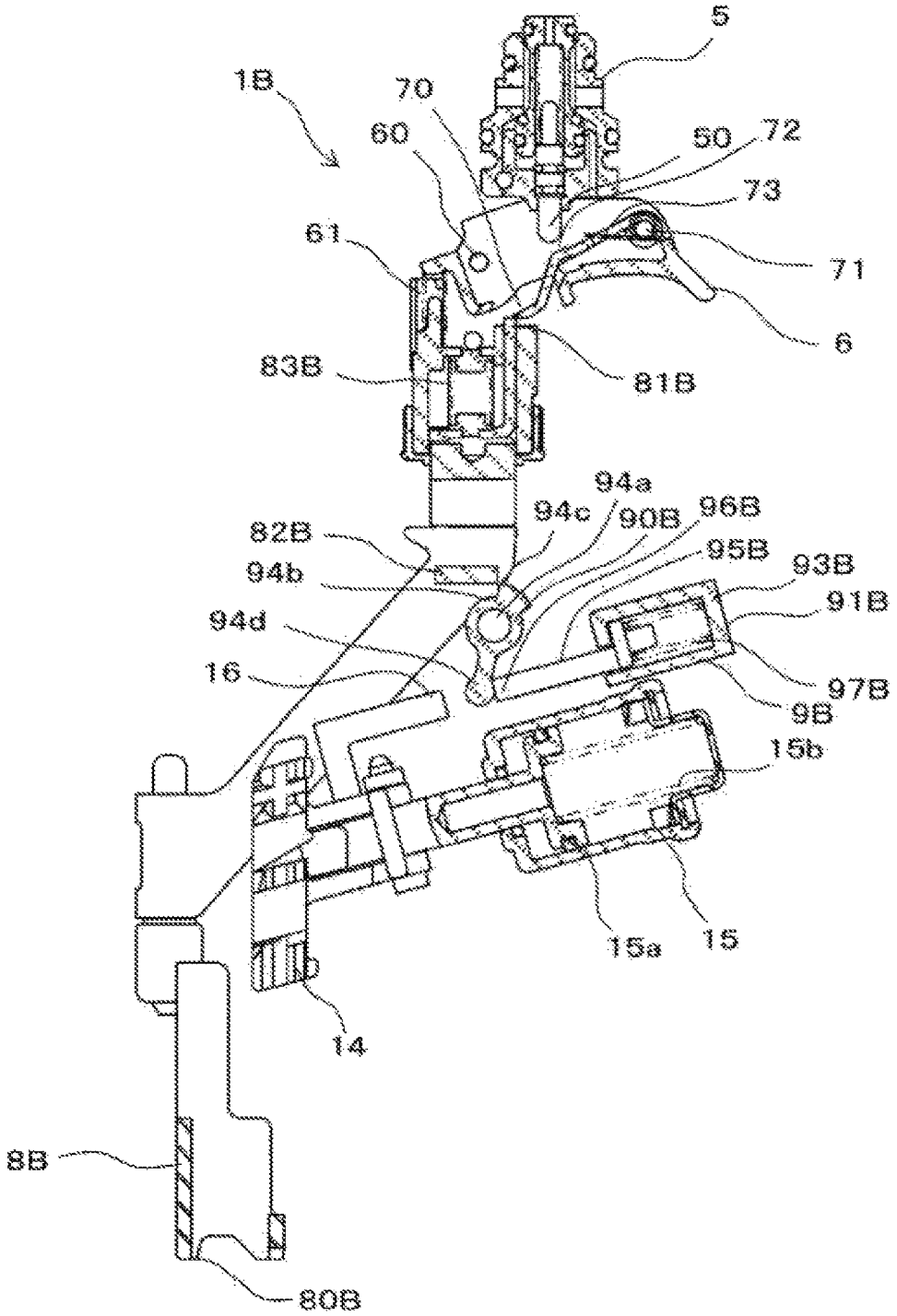
FIG. 14 is a diagram for illustrating an example of a nail driving operation according to the second embodiment.

Therefore, as shown in FIG. 14, while the moving member 95B moves from the time measurement starting position to the initial position, the contact lever 7 and the contact arm 8B stop at the lockable position and the locked state of the lock portion 70 of the contact lever 7 by the pressing portion 81B of the contact arm 8B is maintained.

As a result, while the trigger 6 is maintained at the operating position in a state of being pulled, before a predetermined time passes after the contact lever 7 and the contact arm 8B are moved to the lockable position before the moving member 95B moves from the time measurement starting position to the initial position, when the contact arm 8B is pressed again by the driven member and moved from the initial position to the operating position, the pressing portion 81B of the contact arm 8B may press the lock portion 70 of the contact lever 7.

Therefore, while the trigger 6 is at the operating position in a state of being pulled, when the contact lever 7 and the contact arm 8B are moved to the lockable position and then the contact arm 8B is moved again to the operating position, as shown in FIG. 12, the lock portion 70 of the contact lever 7 is pressed by the pressing portion 81B of the contact arm 8B so that the contact lever 7 is moved to the operating position, and then, the pressing portion 72 presses the valve stem 50 of the starting valve 5.

Therefore, while the trigger 6 is at the operating position in a state of being pulled, continuous striking operations may be performed for a predetermined time period by pressing the contact arm 8B against the driven member.

On the other hand, while the trigger 6 is at the operating position in a state of being pulled, when a predetermined time passes after the contact lever 7 and the contact arm 8B are moved to the lockable position, the moving member 95B is moved to the initial position by the damper 91B.

Figure 15:
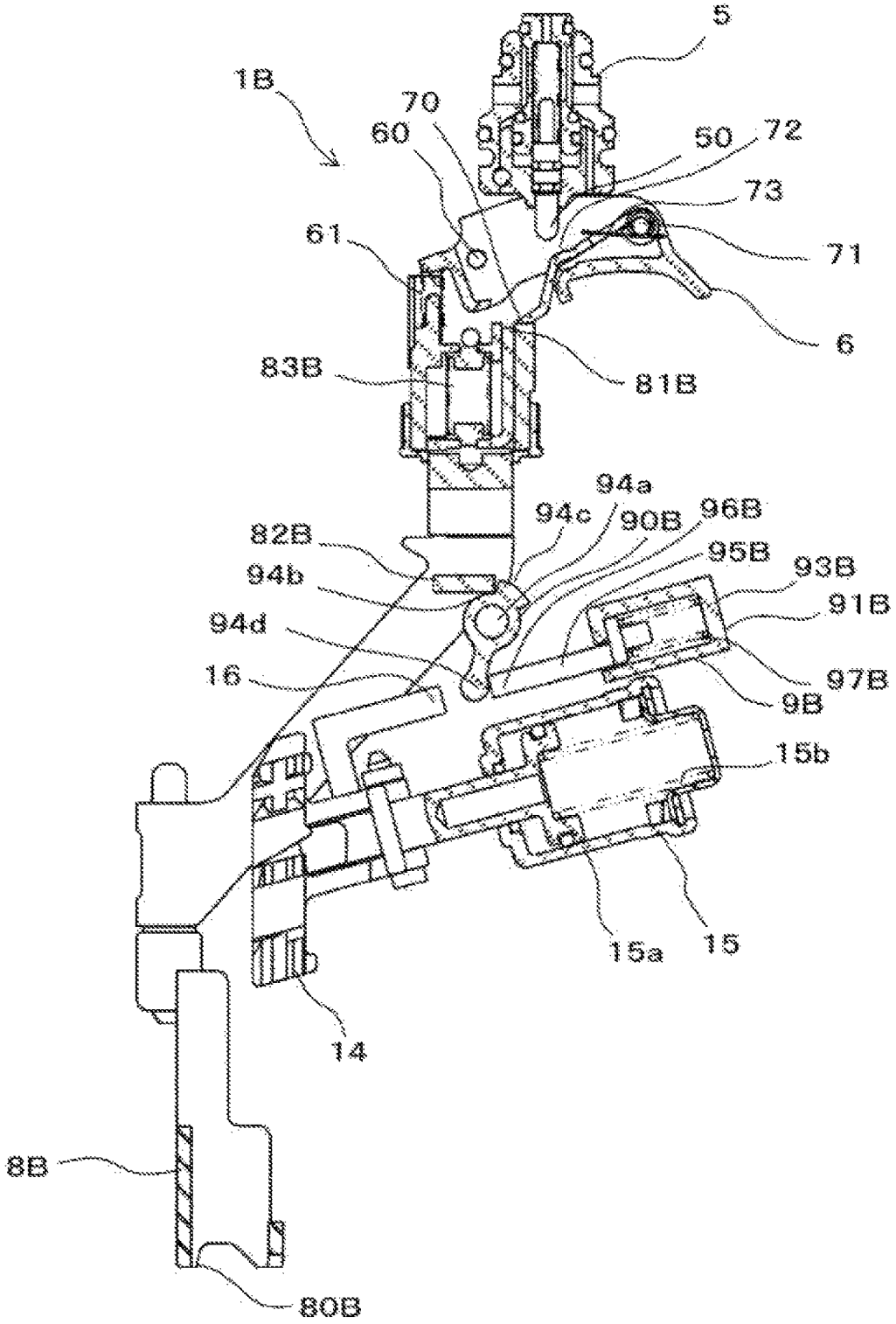
FIG. 15 is a diagram for illustrating an example of a nail driving operation according to the second embodiment.

When the moving member 95B is moved to the initial position, as shown in FIG. 15, the first abutted portion 94*b* of the regulation member 90B is located on the movement path of the position regulator 82B of the contact arm 8B. Then, the contact arm 8B is moved to the initial position where the position regulator 82B is in contact with the first abutted portion 94*b* of the regulation member 90B. In addition, the contact lever 7 moves from the lockable position to the initial position by rotating about the axis 71 due to the force of the spring 73, in linkage with the operation of the contact arm 8B moving to the initial position.

When the contact lever 7 is moved to the initial position in a state where the trigger 6 is maintained at the operating position, the lock portion 70 of the contact lever 7 is evacuated from the movement path of the pressing portion 81B of the contact arm 8B.

Figure 16:
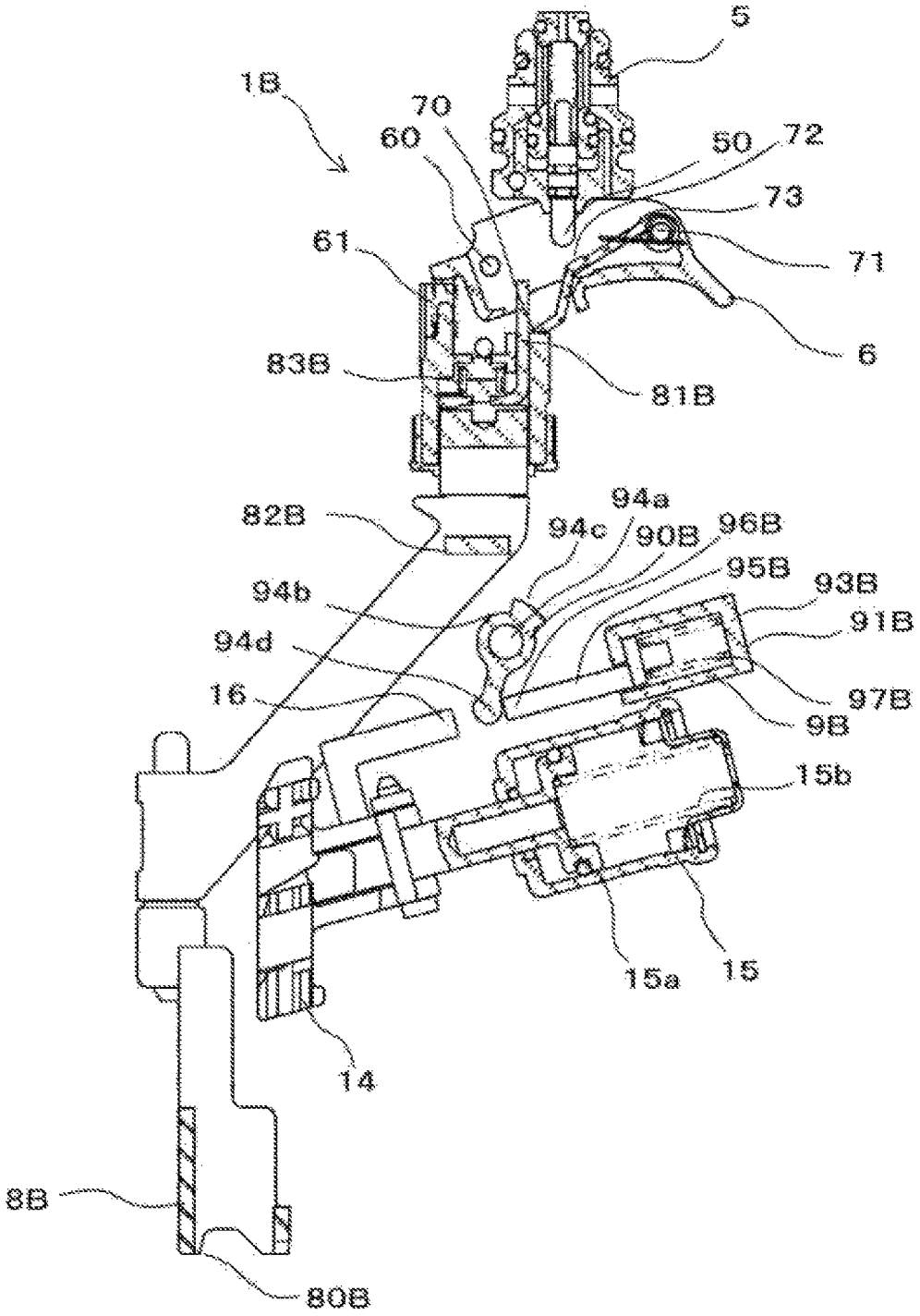
FIG. 16 is a diagram for illustrating an example of a nail driving operation according to the second embodiment.

As a result, when a predetermined time passes while the manipulation of pressing the contact arm 8B against the driven member is released and the trigger 6 is at the operating position in a state of being pulled, as shown in FIG. 16, even when the contact arm 8B is moved to the operating position by the operation of pressing the contact arm 8B against the driven member, the pressing portion 81B of the contact arm 8B is not in contact with the lock portion 70 of the contact lever 7, and the contact lever 7 is not pressed.

Therefore, the starting valve 5 is not pressed by the contact lever 7, and the nailing operation is not performed. Therefore, while the trigger 6 is maintained at the operating position in a state of being pulled, the contact arm 8B is pressed against the driven member, and thus, the continuous nailing operations may be controlled according to lapse of time by using a mechanical configuration.

As described above, when the nailing operation is finished and a predetermined time passes after the force pressing the contact arm 8B is released, the contact lever 7 and the contact arm 8B are moved to the initial position. Also, the trigger 6 is moved to the initial position when the force of pulling the trigger 6 is released. As a result, the initial state as shown in FIG. 9 may be obtained. In the initial state, the lock portion 70 of the contact lever 7 is moved to the movement path of the pressing portion 81B of the contact arm 8B.

As shown in FIG. 11, after the contact arm 8B is moved to the operating position by pressing the contact arm 8B against the driven member, as shown in FIG. 12, when the trigger 6 is pulled to move to the manipulation position, the valve stem 50 of the starting valve 5 is pressed by the contact lever 7 moving to the operable position and the nailing operation may be performed.

In the initial state shown in FIG. 9, when the trigger 6 is pulled and moved to the operating position before pressing the contact arm 8B against the driven member, the lock portion 70 of the contact lever 7 is evacuated from the movement path of the pressing portion 81B of the contact arm 8B.

As a result, after setting the trigger 6 at the operating position in a state of pulling the trigger 6, even when the contact arm 8B is moved to the operating position by pressing the contact arm 8B against the driven member, the pressing portion 81B of the contact arm 8B does not contact the lock portion 70 of the contact lever 7 and thus the contact lever 7 is not pressed.

Therefore, the valve stem 50 of the starting valve 5 is not pressed by the contact lever 7, and the nailing operation is not performed. Therefore, before the trigger 6 is pulled, a nailing operation caused by other operations than a regular procedure of pressing the contact arm 8B against the driven member may be restricted.

The regulator may be configured to move with the compressed air that is a driving source of the striking mechanism 2, in addition to the configuration in which the regulator 9 is operated by the contact arm 8B as illustrated in the first embodiment and the configuration in which the regulator 9B is operated by the feed member 14 as illustrated in the second embodiment. For example, the compressed air supplied to the striking mechanism 2 may be used to drive the driver 20, the compressed air supplied to the blowback chamber 31 may be used to return the driver 20, and the compressed air for driving the feed member 14 may be used.

What is claimed is:

1. A driving tool which is configured to drive a fastener supplied to a nose by using a striking mechanism, the driving tool comprising:

a trigger that is configured to receive a manipulation which operates the striking mechanism;

a contact arm that is configured to reciprocate and that is configured to receive another manipulation which operates the striking mechanism;

a contact lever that is configured to operate according to operations of the trigger and the contact arm and that is configured to switch operating states of the striking mechanism; and a regulator that is configured to regulate a movement of the contact lever in a range from an operable position where the striking mechanism is operable by the contact lever to an operation standby position where the contact lever is operable by the contact arm, according to a reciprocating movement of the contact arm, and that is configured to switch operating states of the contact lever according to the contact arm, wherein the regulator includes:

a regulation member that is configured to regulate the movement of the contact lever by moving to a return regulated position where the regulation member regulates a location of the contact lever at the operation standby position;

a moving member that is configured to operate the regulation member; and a controller that is configured to control moving time of the moving member when the moving member moves from a time measurement starting position to an initial position.

2. The driving tool according to claim 1, wherein the controller controls a velocity of the moving member according to a load.

3. The driving tool according to claim 2, wherein the load includes at least one of a sliding load and a load according to fluid viscosity.

4. The driving tool according to claim 1, wherein the regulator is pressed by the contact arm which moves from an initial position to an operating position where the contact lever is operable, via an operation in which the contact arm is pressed by a driven member, the moving member moves from the initial position to the time measurement starting position where a measurement of time for regulating the movement of the contact lever starts, and the regulation member regulates the contact lever at the operation standby position by moving to the return regulated position, and when the contact arm moves from the operating position to the initial position, a pressed state of the moving member is released, and the moving member moves from the time measurement starting position to the initial position with a velocity controlled by the controller, to release a restricted state of the contact lever by the regulation member.

5. The driving tool according to claim 4, wherein in a case where the trigger is at an operating position in a state of being pulled and the contact arm is pressed by a driven member again after the contact arm moves from the operating position to the initial position and while the moving member moves from the time measurement starting position to the initial position, the contact arm moves from the initial position to the operating position again to lock with the contact lever, and the contact lever locked with the contact arm moves from the operation standby position to the operable position to actuate the striking mechanism.

6. The driving tool according to claim 4, wherein in a case where the trigger is at an operating position in a state of being pulled and the contact arm is pressed by a driven member again after the contact arm moves from the operating position to the initial position and after the moving member reaches the initial position from the time measurement starting position, the regulation member moves from the return regulated position to an initial position, and the contact lever moves from the operation standby position to an initial position not to actuate the striking mechanism.

7. The driving tool according to claim 1, further comprising:

a feed member that is configured to supply a fastener to the nose, wherein the regulation member moves to the return regulated position by a feeding operation of the feed member to regulate the contact lever at the operation standby position, and the moving member moves from the time measurement starting position to the initial position with a velocity controlled by the controller, to release a restricted state of the contact lever by the regulation member.

8. The driving tool according to claim 1, wherein the operation standby position is a lockable position where the contact lever is locked by the contact arm.

9. The driving tool according to claim 1, wherein, while the moving member moves to the initial position from the time measurement starting position where a measurement of time for regulating the movement of the contact lever starts, a lock portion of the contact lever is on a movement path of a pressing portion of the contact arm.

10. The driving tool according to claim 1, wherein the contact lever is rotatably supported by the trigger.

11. The driving tool according to claim 1, wherein the regulator includes a damper that maintains a state in which the contact lever is located at a lockable position where the contact lever is locked by the contact arm, for a predetermined time period.

* * * * *